US011577259B2

(12) United States Patent
Forgey et al.

(10) Patent No.: US 11,577,259 B2
(45) Date of Patent: Feb. 14, 2023

(54) ADJUSTABLE FLOW NOZZLE SYSTEM

(71) Applicant: Shellback Semiconductor Technology, LLC, Gilbert, AZ (US)

(72) Inventors: Christian K. Forgey, Round Rock, TX (US); Mark Nelson, Reading, PA (US); Alexander Trufanov, Souderton, PA (US)

(73) Assignee: Shellback Semiconductor Technology, LLC, Gilbert, AZ (US)

( * ) Notice: Subject to any disclaimer, the term of this patent is extended or adjusted under 35 U.S.C. 154(b) by 92 days.

(21) Appl. No.: 17/229,241

(22) Filed: Apr. 13, 2021

(65) Prior Publication Data

US 2021/0229115 A1 Jul. 29, 2021

Related U.S. Application Data

(62) Division of application No. 15/892,230, filed on Feb. 8, 2018, now Pat. No. 11,071,989.

(60) Provisional application No. 62/456,549, filed on Feb. 8, 2017.

(51) Int. Cl.

| | |
|---|---|
| ***B05B 1/16*** | (2006.01) |
| ***B05B 1/20*** | (2006.01) |
| ***B05B 1/30*** | (2006.01) |
| ***B05B 15/658*** | (2018.01) |
| *B05B 1/04* | (2006.01) |

(52) U.S. Cl.

CPC ..... *B05B 1/169* (2013.01); *B05B 1/1609* (2013.01); *B05B 1/20* (2013.01); *B05B 1/202* (2013.01); *B05B 1/3026* (2013.01); *B05B 15/658* (2018.02); *B05B 1/048* (2013.01)

(58) Field of Classification Search

CPC ..... B05B 1/1609; B05B 1/20; B05B 1/202; B05B 1/3026; B05B 15/658; B05B 1/048; B05B 1/14; B05B 11/169

See application file for complete search history.

(56) References Cited

U.S. PATENT DOCUMENTS 4,050,633 A * 9/1977 Courson ..... B21B 45/0233 239/550
4,717,077 A * 1/1988 Takata ..... B05B 15/658 239/548

* cited by examiner

*Primary Examiner* — Qingzhang Zhou
(74) *Attorney, Agent, or Firm* — Polsinelli PC

(57) ABSTRACT

Various embodiments for an adjustable flow nozzle system having a manifold with a plurality of adjustable flow nozzles in which the flow rate of each adjustable flow nozzle may be individually adjusted are described herein.

4 Claims, 20 Drawing Sheets

| | Angle, Degree | Reduce Opening Area, (sq.mm) | Opening, % |
|---|---|---|---|
| 1 | 0 | 0.00 | 100.0 |
| 2 | 5 | 0.81 | 96.3 |
| 3 | 10 | 1.59 | 92.7 |
| 4 | 15 | 2.33 | 89.3 |
| 5 | 35 | 4.93 | 77.5 |
| 6 | 40 | 5.48 | 74.9 |
| 7 | 42 | 5.71 | 73.9 |
| 8 | 55 | 7.06 | 67.7 |
| 9 | 60 | 7.50 | 65.7 |
| 10 | 70 | 8.20 | 62.5 |
| 11 | 80 | 8.65 | 60.4 |
| 12 | 85 | 8.77 | 59.9 |
| 13 | 90 | 9.62 | 56.0 |

FIG. 42

ADJUSTABLE FLOW NOZZLE SYSTEM

CROSS REFERENCE TO RELATED APPLICATIONS

This is a divisional application that claims benefit to U.S. non-provisional application Ser. No. 15/892,230 filed on Feb. 8, 2018, which claims benefit to U.S. provisional application Ser. No. 62/465,549 filed on Feb. 8, 2017, which are herein incorporated by reference in their entirety.

FIELD

The present disclosure relates to an adjustable flow nozzle system and in particular to an adjustable flow nozzle system that adjusts the cross-sectional area of the overall opening formed by each adjustable flow nozzle by selective rotation of at least two openings in overlapping arrangement with respect to each other for establishing between a non-zero minimum flow rate to a maximum flow rate by each individual flow nozzle.

BACKGROUND

Semiconductor processing involves selective removal of polymers or metals from the surface of silicon wafers. This is accomplished through spraying various chemicals—acids or solvents—on a batch of wafers. One of the many factors that influence the removal rate is the flow rate and volume of liquid through the spray nozzles. Currently, the adjustment of flow through each spray nozzle is done at the "macro" level by adjusting the flow to all of the spray nozzles in the manifold at once. Individual spray nozzles can be changed as described, but this individual adjustment of each spray nozzle is both time consuming and may not precisely adjust the flow of liquid through each respective spray nozzle.

BRIEF DESCRIPTION OF THE DRAWINGS

FIG. 42 is a table showing the percentage opening of the adjustable flow nozzle and concurrent reduction in the opening area for each angle of rotation of the manifold orifice insert relative to the retainer orifice insert, according to one aspect of the present disclosure;

Corresponding reference characters indicate corresponding elements among the view of the drawings. The headings used in the figures do not limit the scope of the claims.

DETAILED DESCRIPTION

Figure 1:
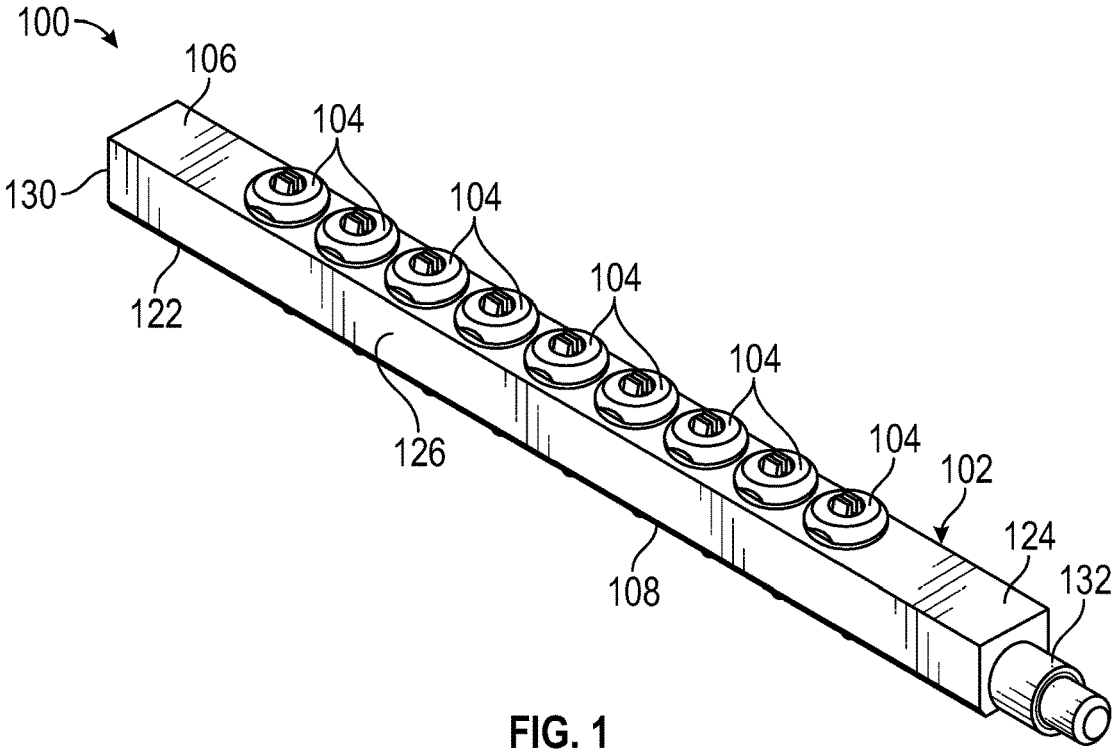
FIG. 1 is a perspective view of an adjustable flow nozzle system showing an adjustable flow manifold, according to one aspect of the present disclosure.

Various embodiments for an adjustable flow nozzle system having a manifold with a plurality of adjustable flow nozzles in which the flow rate of each adjustable flow nozzle may be individually adjusted are described herein. In some embodiments, the adjustable flow nozzle system may be used for semiconductor processing through the spraying of various solvents or acids through a plurality of individually adjustable flow nozzles on a batch of silicon wafers at various flow rates. In some embodiments, each adjustable flow rate nozzle includes a manifold orifice insert that defines at least one opening in overlapping relation with a retainer orifice insert that defines at least one opening in which the overlapping openings are aligned along a common axis of rotation for defining a collective opening that controls the flow rate of fluid through the adjustable fluid nozzle. In some embodiments, adjusting the cross-sectional area of the collective opening as the manifold orifice insert is rotated relative to the retainer orifice insert adjusts the flow rate through the adjustable flow nozzle. In some embodiments, the flow rate of each adjustable flow nozzle is adjusted through the selective overlap of the openings such that each adjustable flow nozzle is adjustable between a non-zero minimum flow rate when minimum overlap between the overlapped openings occurs and a maximum flow rate when maximum overlap between the overlapped openings occurs. In some embodiments, the flow rate of each adjustable flow nozzles may be individually adjusted using an adjustment key that engages and rotates the manifold orifice insert relative to the fixed retainer orifice insert. Referring to the drawings, various embodiments of an adjustable flow nozzle system are illustrated and generally indicated as 100 in FIGS. 1-43.

Referring to FIGS. 1-4, the adjustable flow nozzle system 100 includes an adjustable flow manifold 102 having a plurality of adjustable flow nozzles 104 positioned in series along an elongated manifold body 106. In some embodiments, each of the adjustable flow nozzles 104 may be manually adjusted to a particular flow rate. In some embodiments, each adjustable flow nozzle 104 may be accessed through the interior of the manifold body 106 using an adjustment key 166 to manually adjust the flow rate of each adjustable flow nozzle 104 without requiring each adjustable flow nozzle 104 to be disassembled or require disengagement of the adjustable flow nozzle 104 from the manifold body 106 to adjust the flow rate.

Figure 4:
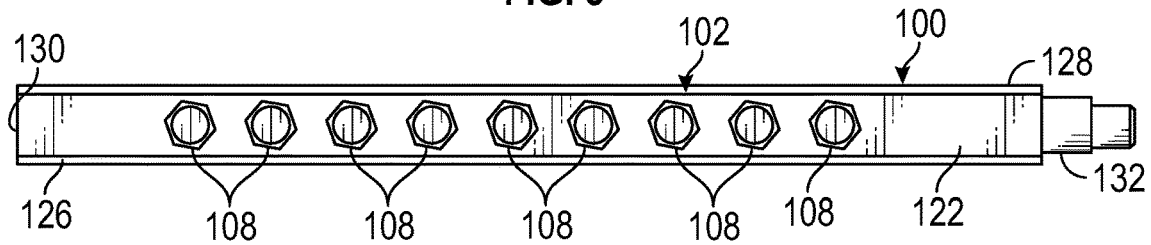
FIG. 4 is a top view of the adjustable flow manifold showing a plurality of plugs that seal respective access openings, according to one aspect of the present disclosure.

As shown in FIGS. 6-11, the manifold body 106 is collectively defined by a top side 122, a bottom side 124, a front side 126 and rear side 128 having a distal end portion 130 and an opposite proximal end portion 132 that collectively define the elongated rectangular-shaped manifold body 106. Referring to FIGS. 6 and 8-10, the manifold body 106 defines a plurality of access openings 134 arranged in series along the top side 122 of the manifold body 106 and configured to be sealed by a respective plug 108 (FIG. 4).

Figure 39:
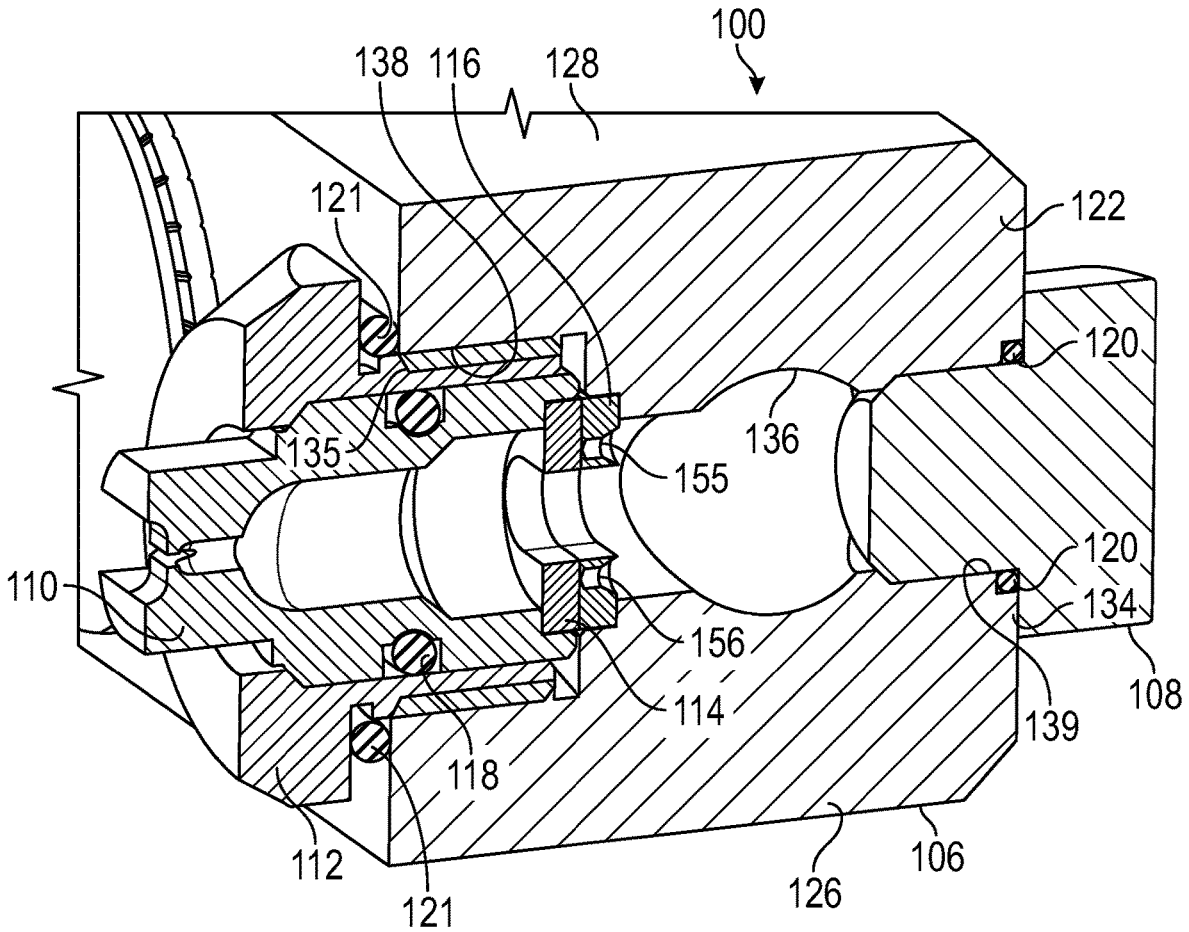
FIG. 39 is a cross-sectional view of the adjustable flow manifold showing the access opening to the adjustable flow nozzle sealed by the plug, according to one aspect of the present disclosure.

Referring to FIGS. 24-27, each plug 108 is configured to seal a respective access opening 134 during operation of the nozzle flow system 100. In some embodiments, the plug 108 includes a cap portion 160 and a base portion 161 that extends axially from the cap portion 160. As shown in FIG. 39, the base portion 161 is configured to engage and seal off the access cavity 139, while the cap portion 160 seals off the access opening 134 for establishing a water-tight seal between the plug 108 and the manifold body 106.

Figure 6:
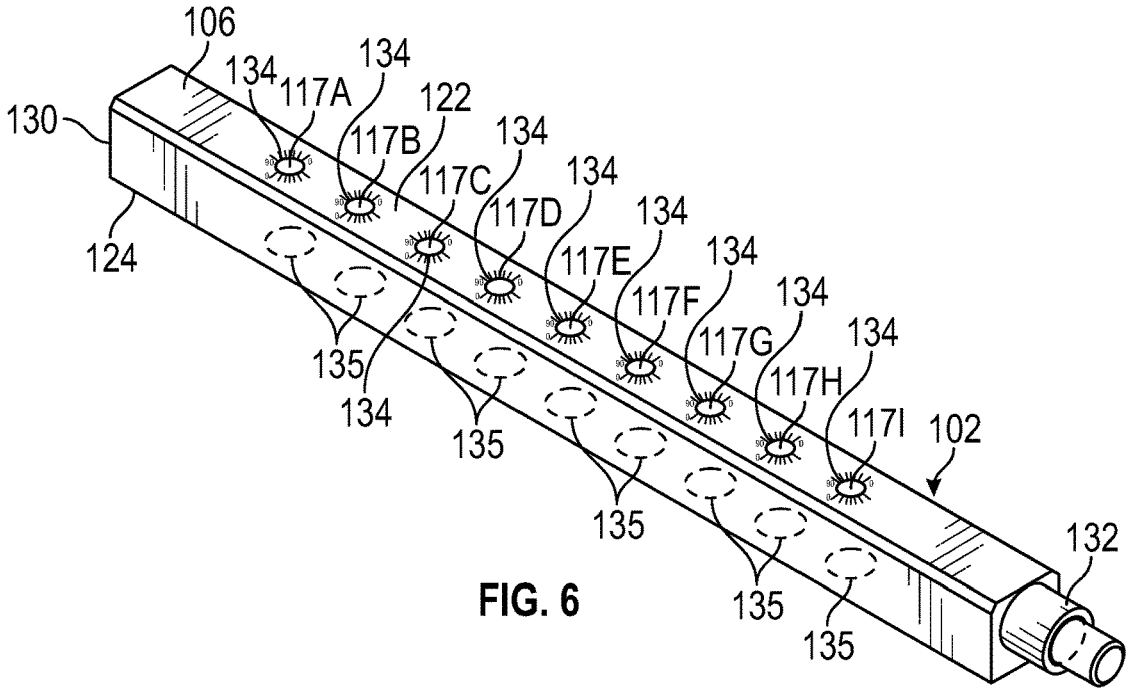
FIG. 6 is a perspective view of a manifold body for the adjustable flow manifold, according to one aspect of the present disclosure.
Figure 7:
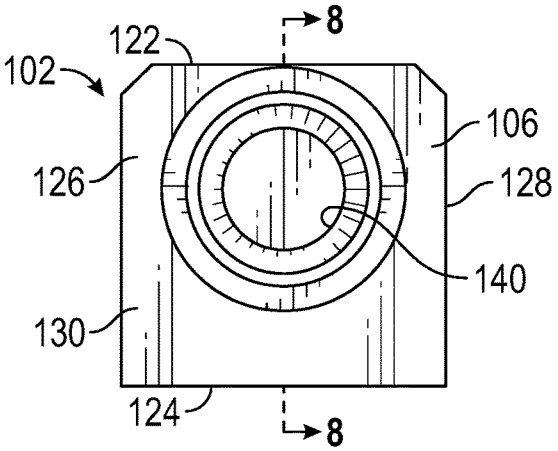
FIG. 7 is an end view of the manifold body of FIG. 6.
Figure 8:
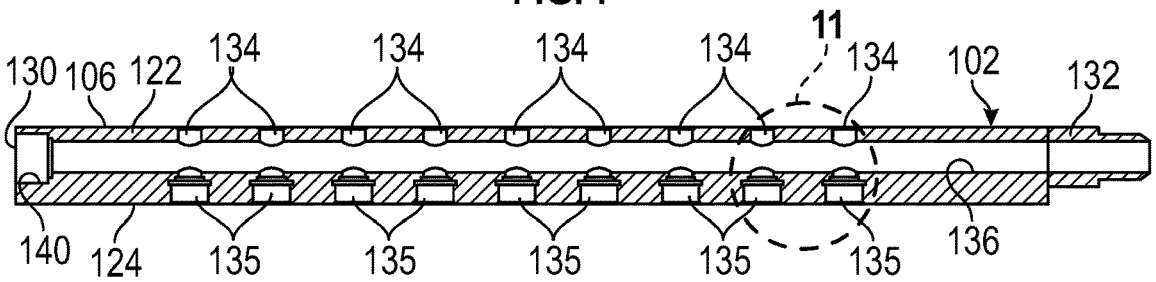
FIG. 8 is a cross-sectional view of the manifold body taken along line 8-8 of FIG. 7, according to one aspect of the present disclosure.
Figure 9:
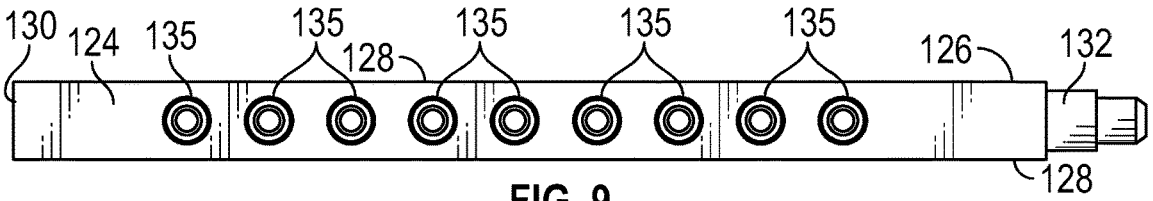
FIG. 9 is a bottom view of the manifold body, according to one aspect of the present disclosure.
Figure 10:
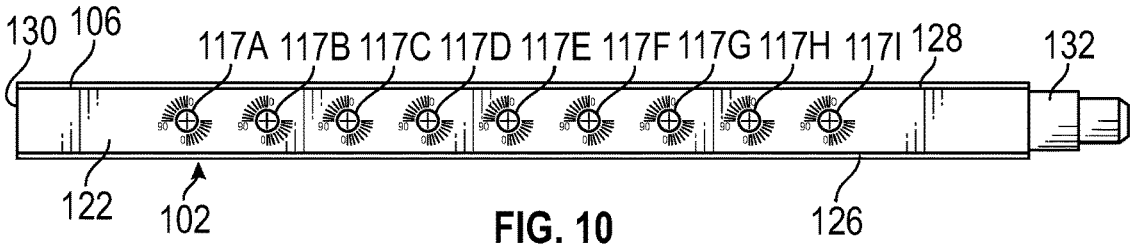
FIG. 10 is a top view of the manifold body, according to one aspect of the present disclosure.
Figure 11:
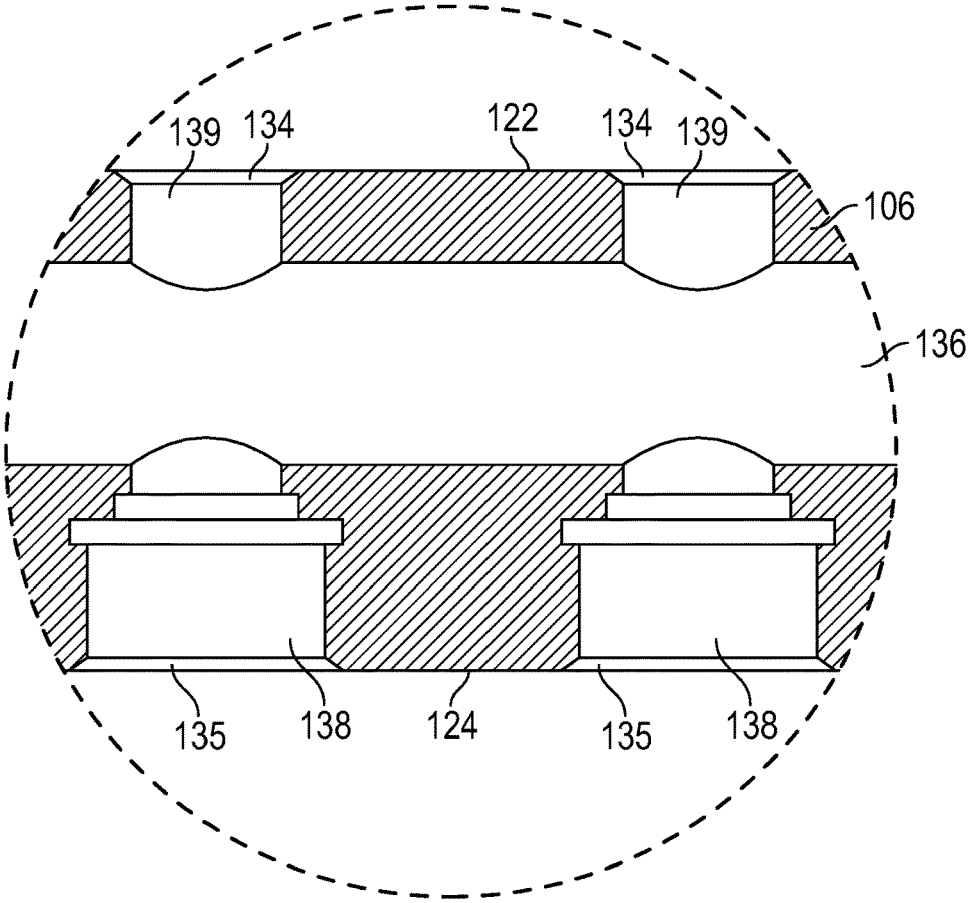
FIG. 11 is an enlarged cross-sectional view taken along line 11-11 of FIG. 8, according to one aspect of the present disclosure.
Figure 44:
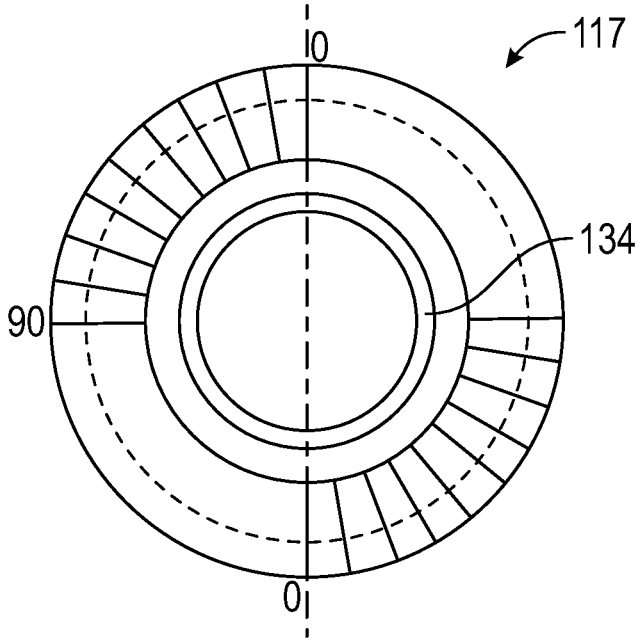
FIG. 44 is an enlarged view of FIG. 10 showing the setting indicia used to adjust the manifold orifice insert, according to one aspect of the present disclosure.
Figure 45:
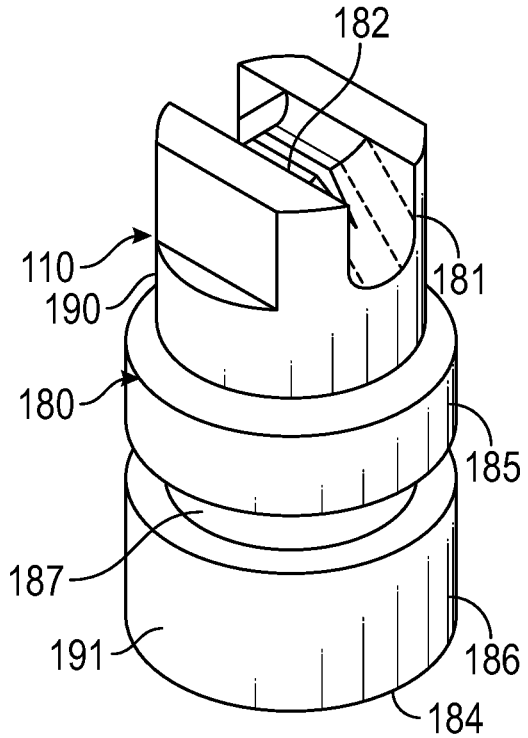
FIG. 45 is a perspective view of the manifold body shown in FIG. 8, according to one aspect of the present disclosure.
Figure 46:
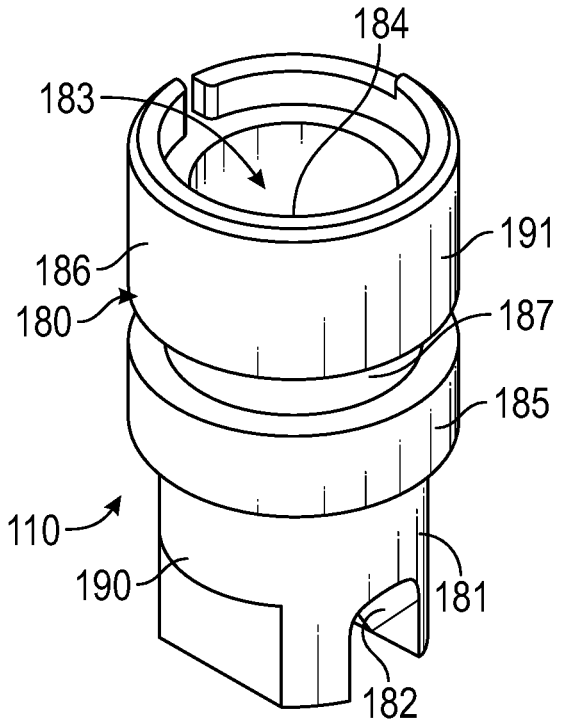
FIG. 46 is an opposite perspective view of the nozzle component, according to one aspect of the present disclosure.
Figure 47:
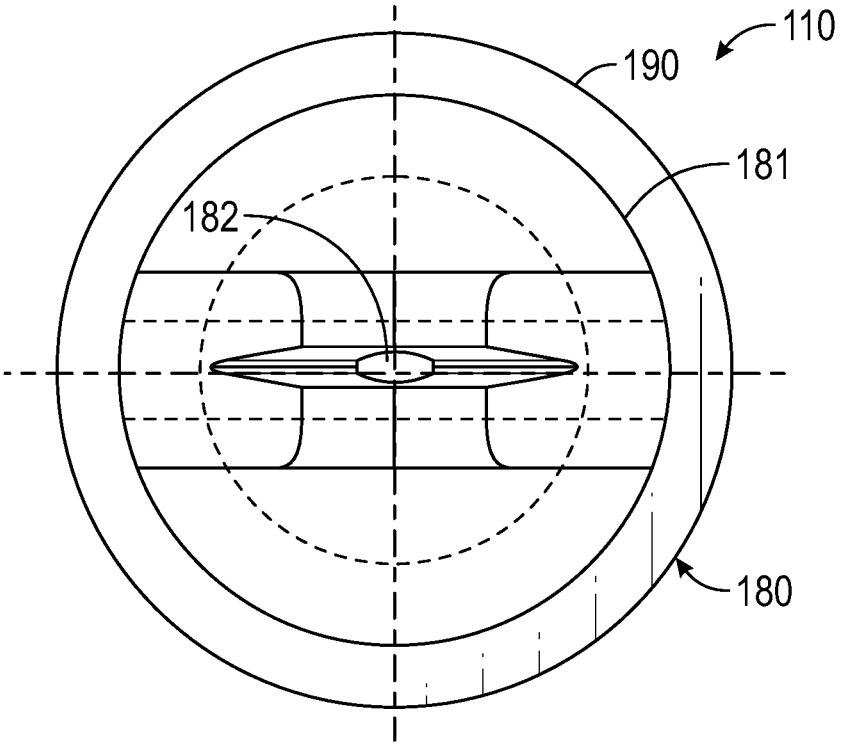
FIG. 47 is an end view of the nozzle component, according to one aspect of the present disclosure.
Figure 48:
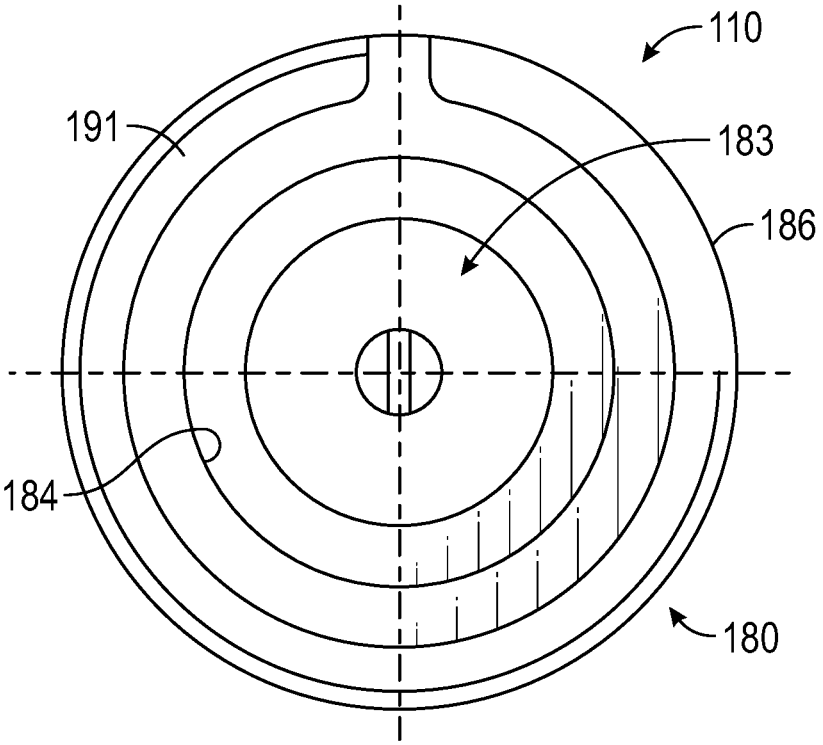
FIG. 48 is an opposite end view of the nozzle component, according to one aspect of the present disclosure.
Figure 50:
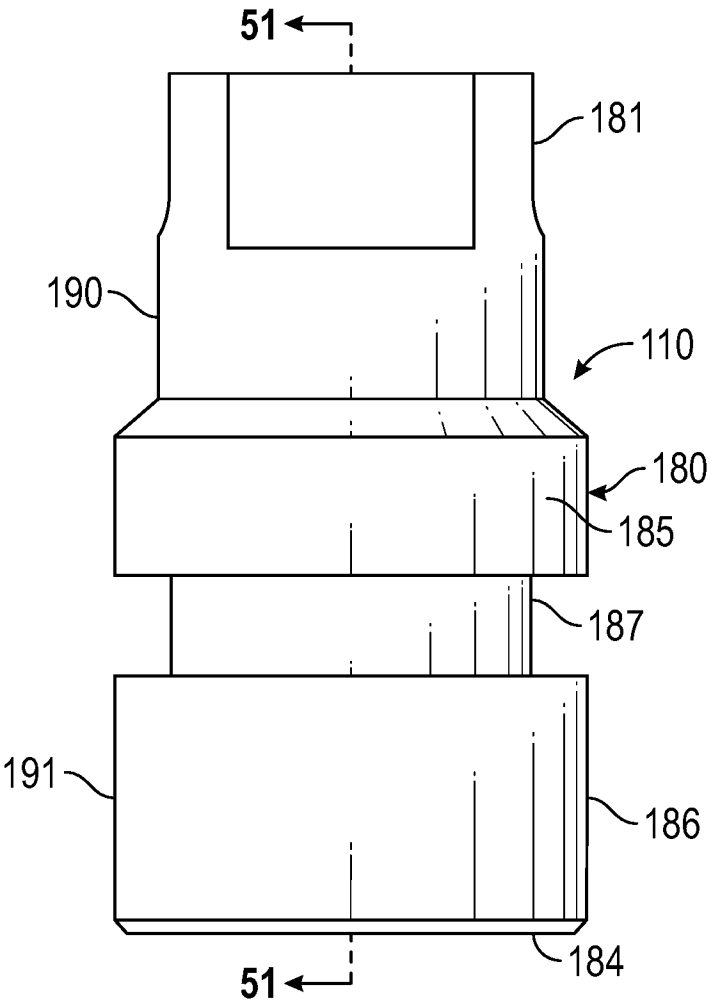
FIG. 50 is an opposite side view of the nozzle component, according to one aspect of the present disclosure.
Figure 49:
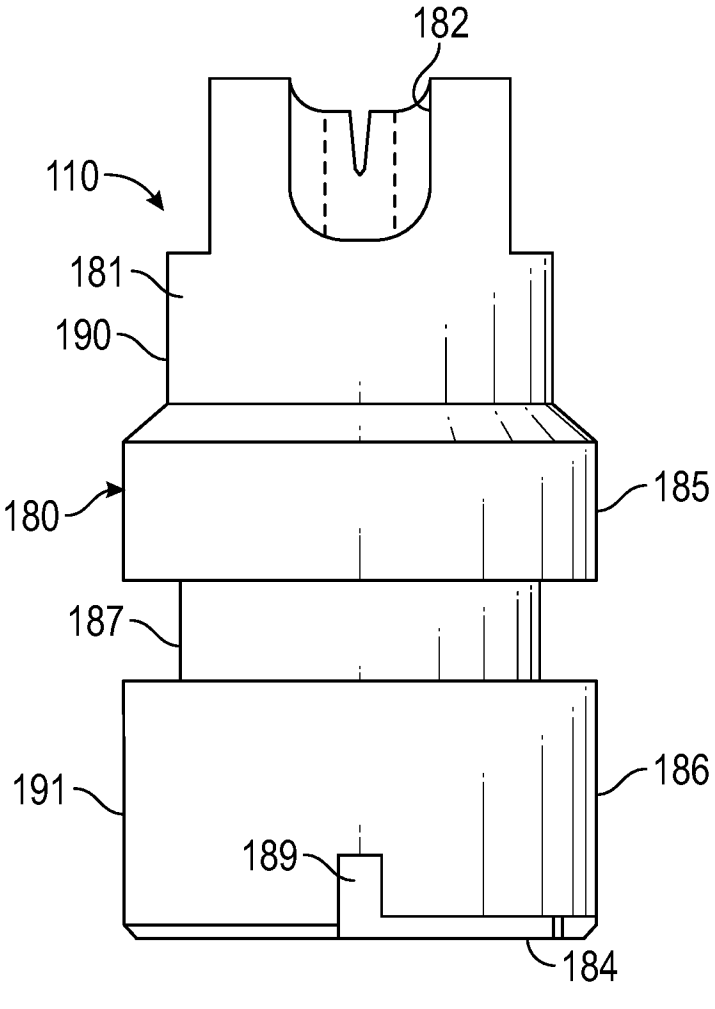
FIG. 49 is a side view of the nozzle component, according to one aspect\ of the present disclosure.

As shown in FIGS. 6 and 8, the manifold body 106 further defines a plurality of apertures 135 arranged in series along the bottom side 124 of the manifold body 106 and configured to be engaged to a respective adjustable flow nozzle 104. As shown in FIG. 11, each access opening 134 communicates with a respective access cavity 139 and each aperture 135 communicates with a respective nozzle cavity 138. The nozzle cavity 138 is configured to receive the adjustable flow nozzle 104. In some embodiments, each respective access opening 134 is located directly opposite a respective aperture 135 such that the adjustable flow nozzle 104 may be accessed through the access opening 134 to manually adjust the flow rate of the adjustable flow nozzle 104 as shall be described in greater detail below. As shown in FIGS. 10 and 44, in some embodiments a setting indicia 117 may be engraved or placed around each respective access hole 134 to provide a visual indicator of flow rate for a user when manually adjusting the flow rate desired for each respective adjustable flow nozzle 104. As shown in FIG. 10, a respective setting indicia 117A-1171 may be associated with each adjustable flow nozzle 104. In some embodiments, the setting indicia 117 may be preset numbers, lines, visual indicators or a combination thereof that provide the user with a visual indication of flow rate being applied to each respective adjustable flow nozzle 104.

As further shown in FIG. 11, the proximal end portion 132 of the manifold body 106 defines a proximal opening 141 and the distal end portion 130 of the manifold body 106 defines a distal opening 140. The manifold body 106 further defines an axial channel 136 in communication with the distal opening 140 at one end and proximal opening 141 at the opposite end of the axial channel 136. As noted above, each access opening 134 is configured to be engaged to a plug 108 to seal access to the axial channel 136 as well as the rear portion of the adjustable flow nozzle 104. In addition, each aperture 135 is configured to be engaged to a respective adjustable flow nozzle 104 positioned opposite a respective plug 108.

Figure 41:
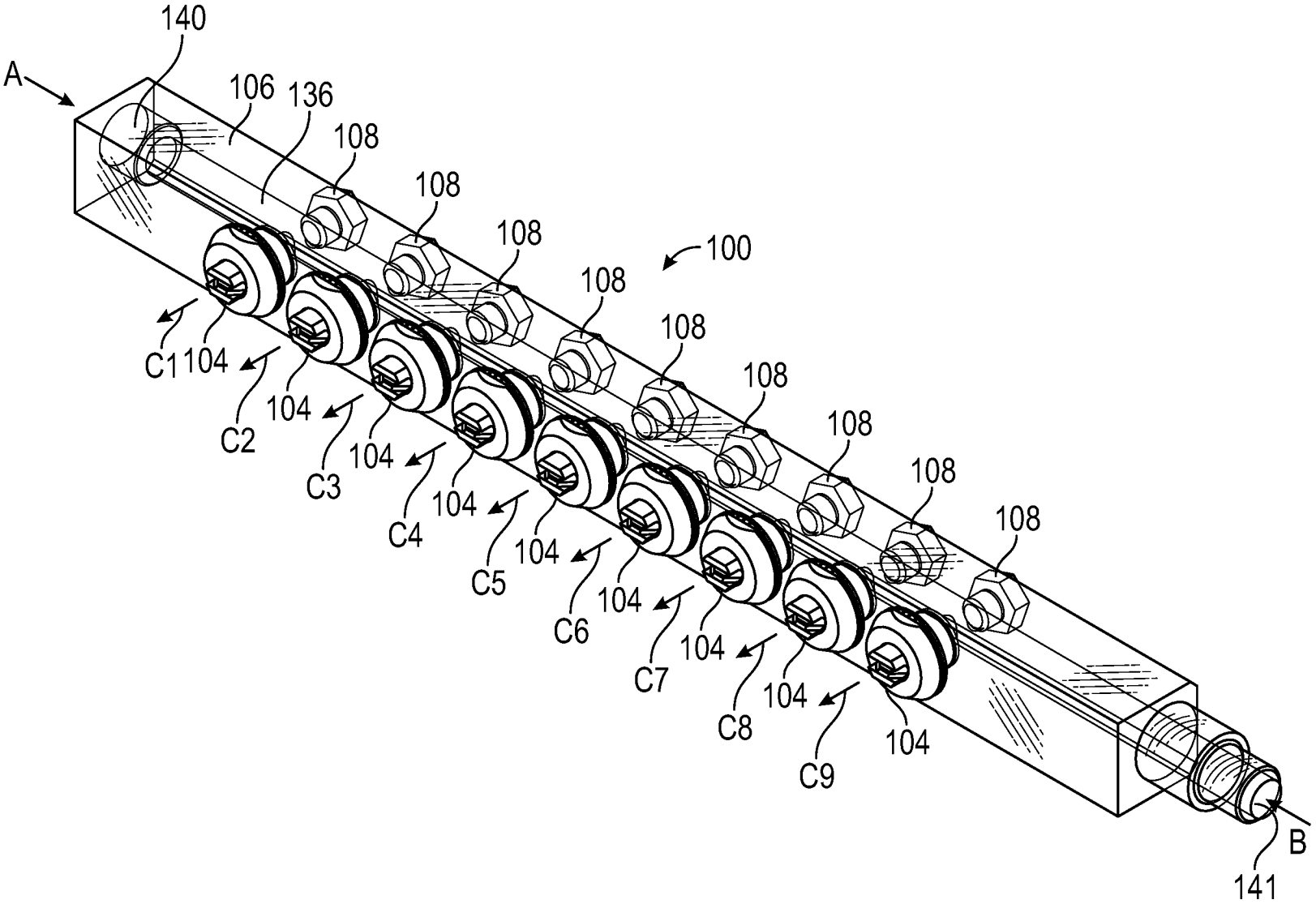
FIG. 41 is a perspective view of the adjustable flow manifold showing the flow of liquid through the manifold body, according to one aspect of the present disclosure.

FIG. 41 illustrates the fluid pathway through the adjustable flow manifold 102. As shown, inlet flow A enters the axial channel 136 through the distal opening 140 of the manifold body 106 and inlet flow B enters the opposite end of the axial channel 136 through the proximal opening 141 of the manifold body 106. In one aspect, each adjustable flow nozzle 104 may be manually adjusted to allow a respective outlet flow C1 through outlet flow C9 having the same or different flow rates.

Figure 5:
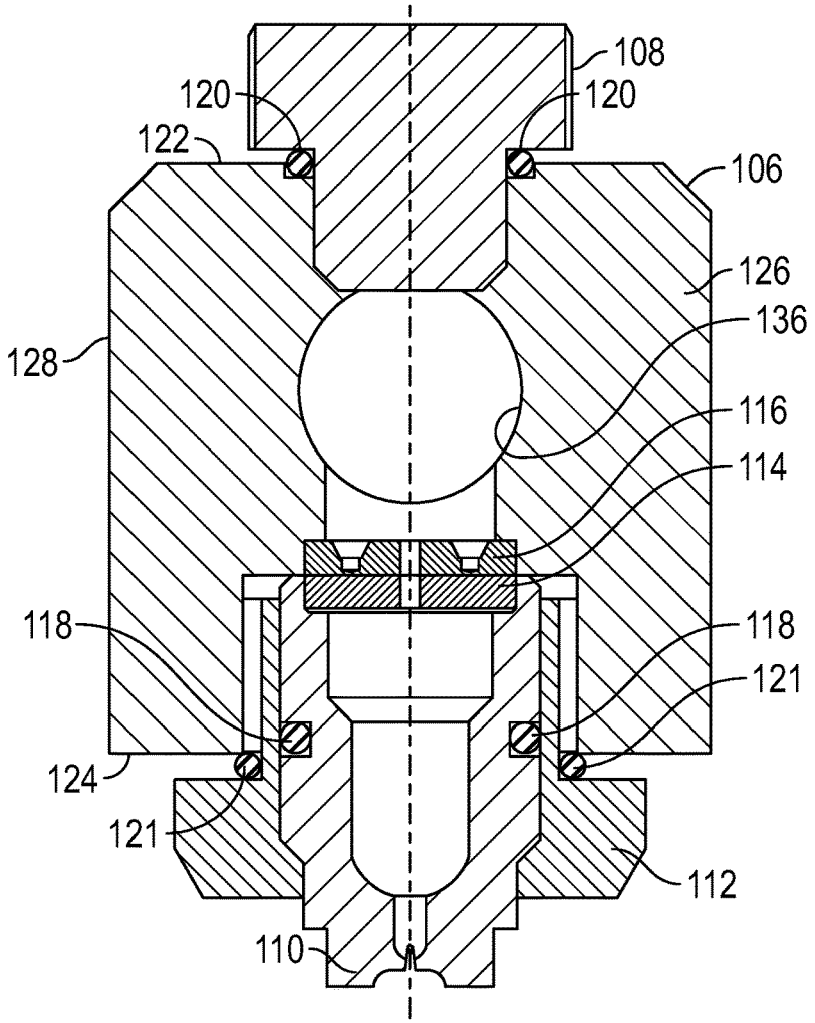
FIG. 5 is a cross-sectional view of the adjustable flow manifold along line 5-5 of FIG. 3 showing one of the plurality of adjustable flow nozzles, according to one aspect of the present disclosure.

As shown in FIG. 5, in some embodiments each adjustable flow nozzle 104 includes an adjustable nozzle component 110 that is manually and individually adjusted to modify the cross-sectional area of a collective opening 158 such that the flow rate for that particular adjustable flow nozzle 104 may be changed to a desired flow rate. As such, each adjustable flow nozzle 104 can be individually adjusted to provide a flow rate that is either the same or different than the other adjustable flow nozzles 104 of the adjustable flow manifold 102.

Figure 2:
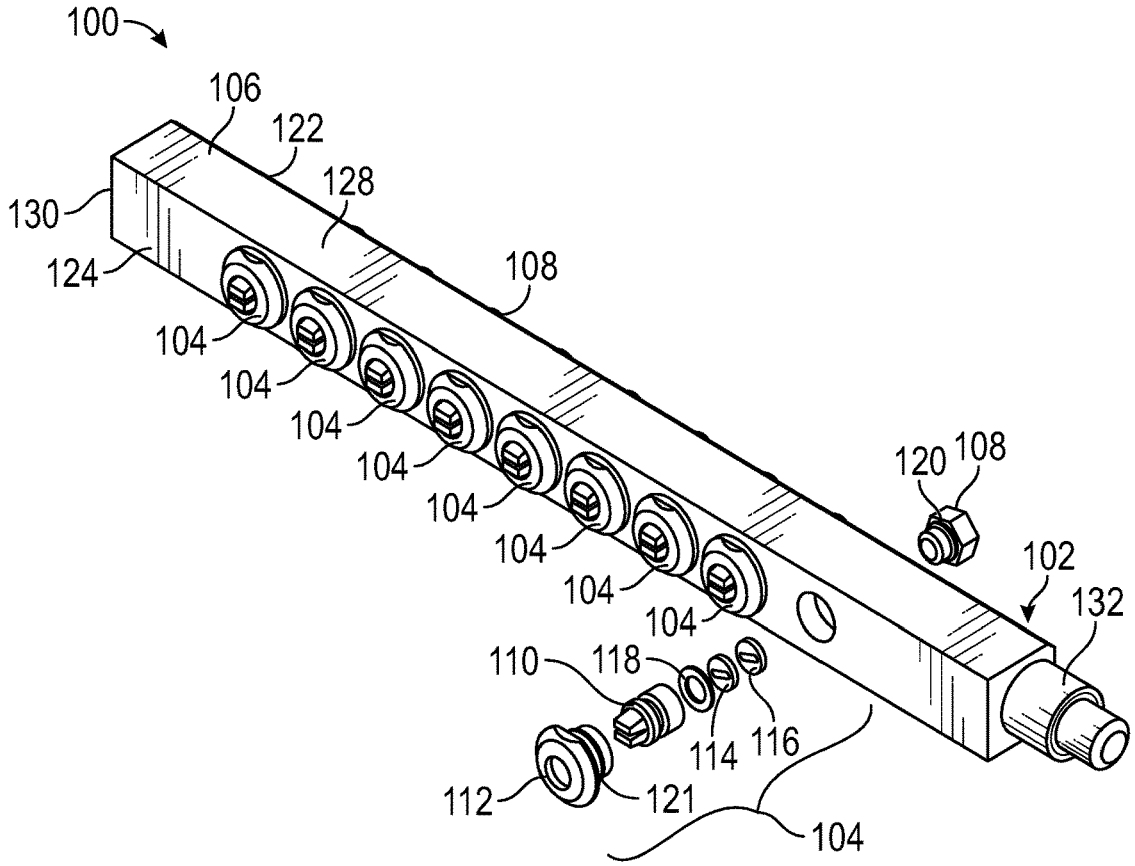
FIG. 2 is a perspective view of the adjustable flow manifold showing the adjustable flow nozzle in an exploded view, according to one aspect of the present disclosure.
Figure 3:
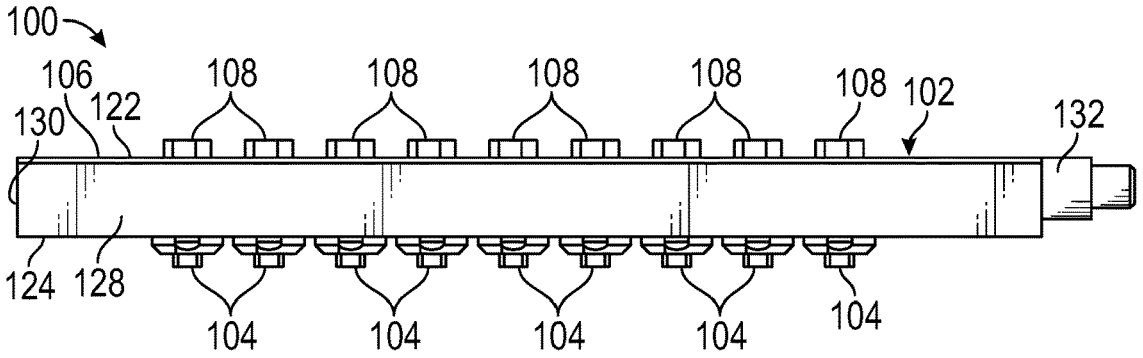
FIG. 3 is a side view of the adjustable flow manifold, according to one aspect of the present disclosure.

Referring to FIGS. 2 and 5, each adjustable flow nozzle 104 includes a retainer orifice insert 114 stacked in overlapping fashion with a manifold orifice insert 116 that is manually rotated relative to the retainer orifice insert 114 to individually adjust the flow rate of the adjustable flow nozzle 104. In assembly, the retainer orifice insert 114 is fixed in position and engaged with the manifold orifice insert 116. In operation, the manifold orifice insert 116 may be manually rotated relative to the stationary retainer orifice insert 114 using the adjustment key 166 to adjust flow rate as shall be described in greater detail below. In some embodiments, each adjustable flow nozzle 104 further includes a nozzle component 110 which is engaged to the retainer orifice insert 114 and functions as a nozzle arrangement for the release of fluid at a predetermined flow rate in a spraying action. In some embodiments, the nozzle component 110 defines a circumferential groove configured to receive an O-ring 118 for establishing a fluid tight seal between the adjustable flow nozzle 104 and the manifold body 106. In addition, the adjustable flow nozzle 104 may include an O-ring 121 that forms part of the assembly for the adjustable flow nozzle 104. As further shown, the plug 108 may include an O-ring 120 that establishes a fluid-tight seal between the plug 108 and the access opening 134.

Figure 51:
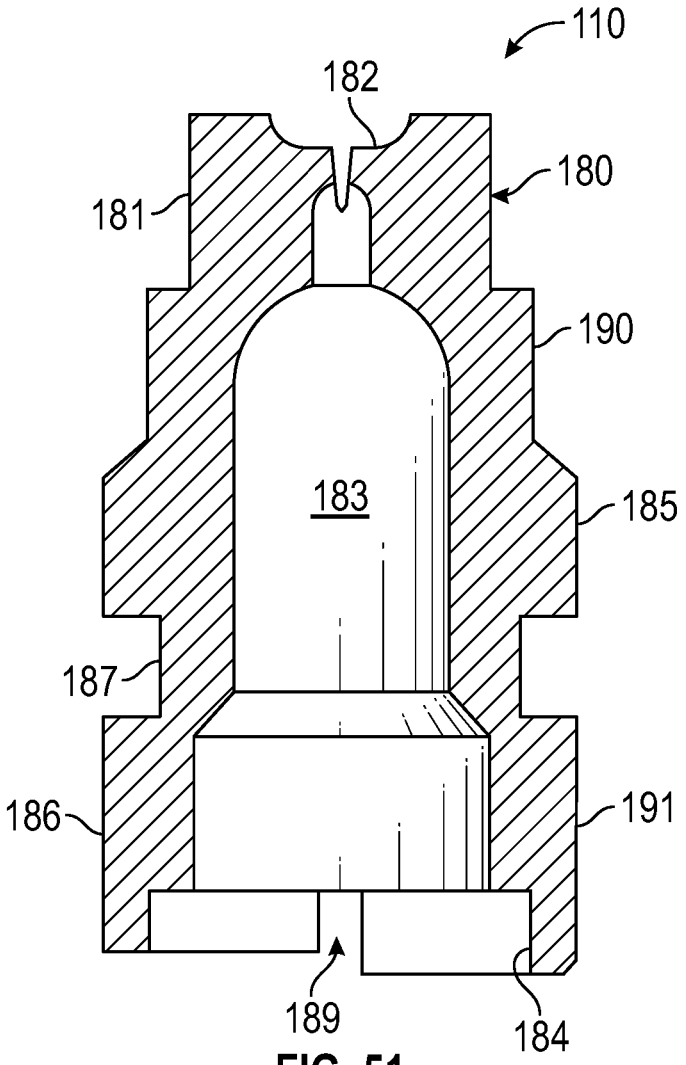
FIG. 51 is a cross-sectional view of the nozzle component taken along line 51-51 of FIG. 50, according to one aspect of the present disclosure.

As shown in FIGS. 5 and 45-51, in some embodiments the nozzle component 110 includes a nozzle body 180 defining a distal end portion 190 forming a nozzle head 181 and a proximal end portion 191 forming a proximal opening 184. The nozzle head 181 defines a nozzle opening 182 configured to provide a spraying action. As shown in FIG. 51, a conduit 183 is defined through the nozzle body 180 and is in fluid flow communication between the nozzle opening 182 and the proximal opening 184 for establishing fluid flow communication through the nozzle component 110. As shown, the nozzle body 180 forms a middle flange 185 and a proximal flange 186 that collectively define groove 187 configured to receive O-ring 118 (FIG. 5). As further shown, in some embodiments a bayonet mount 189 may be formed adjacent the proximal opening 184 configured to engage the nozzle component 110 to the nozzle retainer 112.

Figure 12:
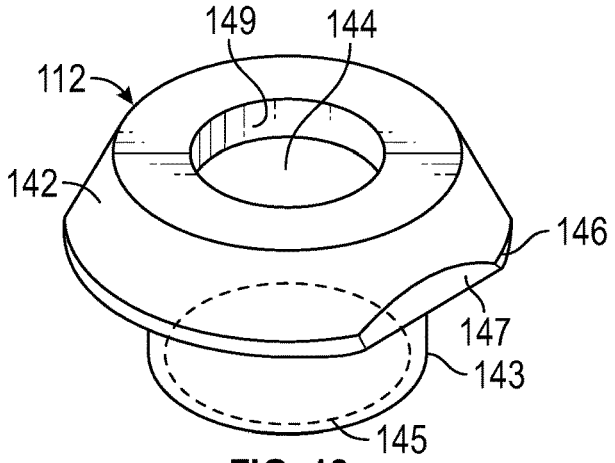
FIG. 12 is a perspective view of a nozzle retainer, according to one aspect of the present disclosure.
Figure 13:
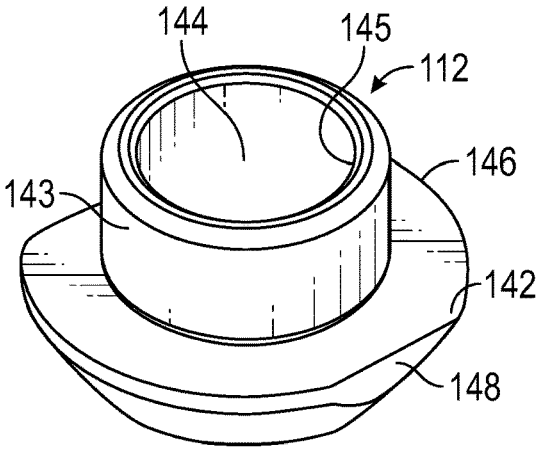
FIG. 13 is an opposite perspective view of the nozzle retainer shown in FIG. 12, according to one aspect of the present disclosure.
Figure 14:
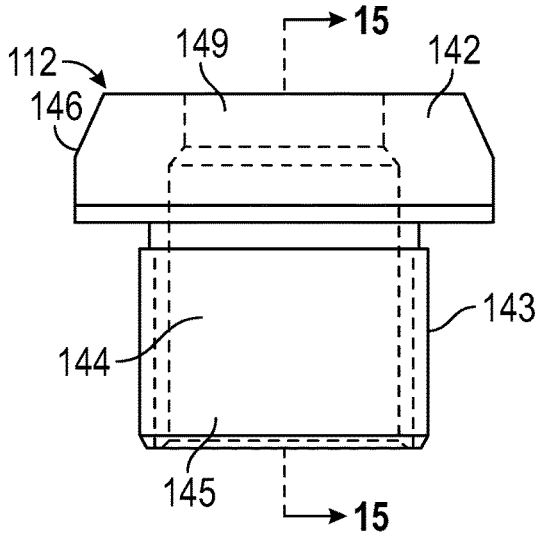
FIG. 14 is a side view of the nozzle retainer showing the channel in phantom line, according to one aspect of the present disclosure.
Figure 15:
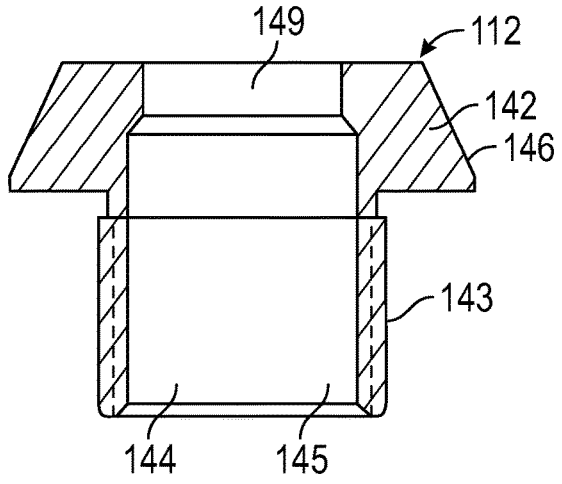
FIG. 15 a partial cross-sectional view of the nozzle retainer, according to one aspect of the present disclosure.
Figure 16:
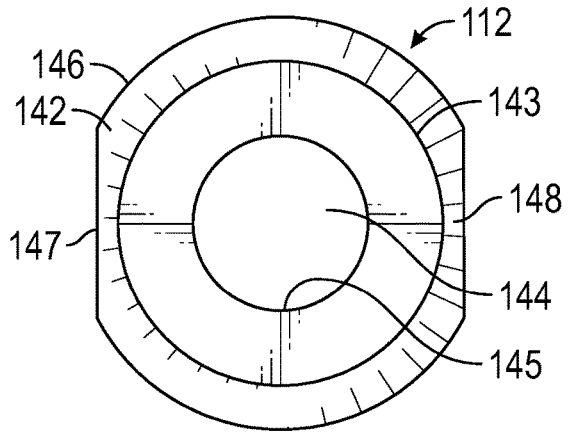
FIG. 16 a top plan view of the nozzle retainer, according to one aspect of the present disclosure.

In some embodiments, the adjustable flow nozzle 104 further includes a nozzle retainer 112 engaged to the nozzle component 110 such that the nozzle component 110 extends through the nozzle retainer 112 and is retained to the manifold body 105. As shown in FIGS. 12-14, in some embodiments the nozzle retainer 112 defines a cap portion 142 and a tubular portion 143 that extends axially from the cap portion 142. The nozzle retainer 112 forms an axial channel 144 in communication with a first axial opening 145 defined through the tubular portion 143 and a second axial opening 149 defined through the cap portion 142. The axial channel 144 is configured to receive the nozzle component 110 such that the nozzle component 110 extends through first and second axial openings 145 and 149 as shown in FIG. 5. In addition, the nozzle retainer 112 forms a peripheral edge 146 defining first and second flat portions 147 and 148 defined opposite of each other as illustrated in FIG. 16. The first and second flat portions 147 and 148 act as gripping surfaces configured to be engaged by the thumb and forefinger for permitting an individual to grip the nozzle retainer 112 when engaging the retainer nozzle 112 to the nozzle component 110 and manifold body 106 during assembly of the adjustable flow nozzle 104.

Figure 17:
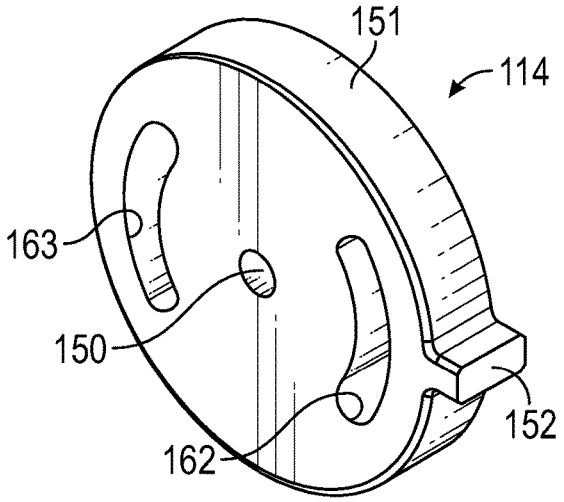
FIG. 17 is a perspective view of a retainer orifice insert for the adjustable flow nozzle, according to one aspect of the present disclosure.
Figure 18:
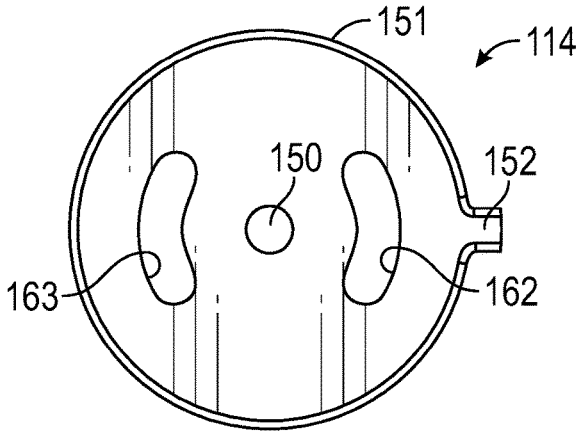
FIG. 18 is a front view of the retainer orifice insert, according to one aspect of the present disclosure.
Figure 19:
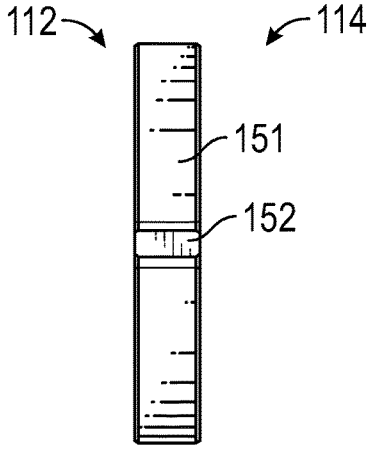
FIG. 19 is a side view of the retainer orifice insert, according to one aspect of the present disclosure.
Figure 20:
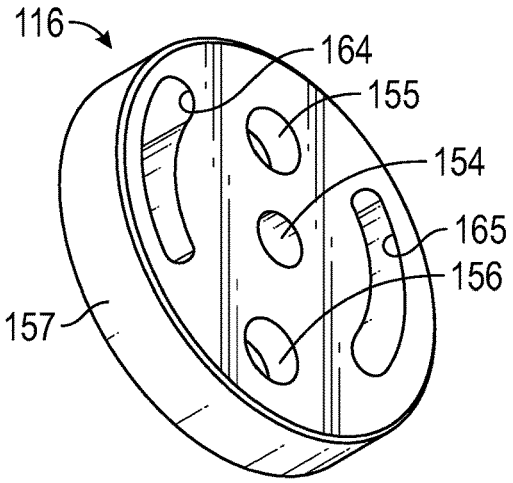
FIG. 20 a perspective view of a manifold orifice insert for the adjustable flow nozzle, according to one aspect of the present disclosure.
Figure 21:
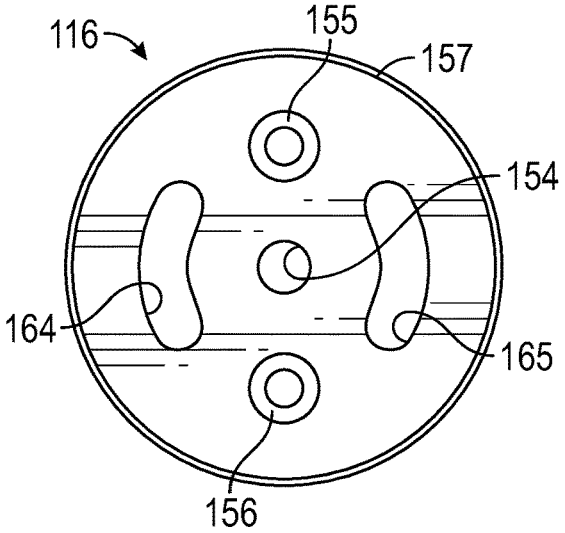
FIG. 21 is a front view of the manifold orifice insert, according to one aspect of the present disclosure.
Figure 22:
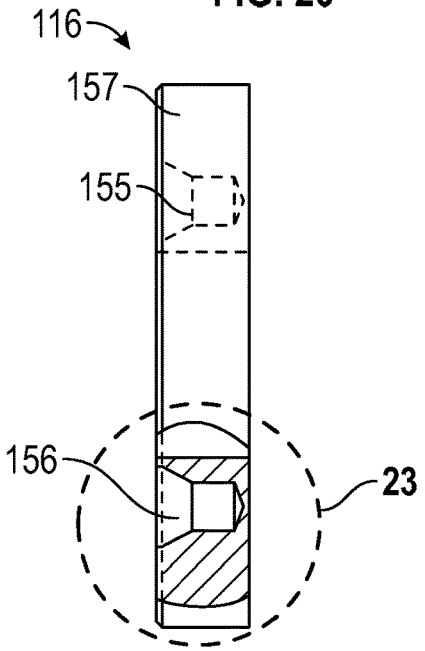
FIG. 22 is a side view of the manifold orifice insert, according to one aspect of the present disclosure.
Figure 23:
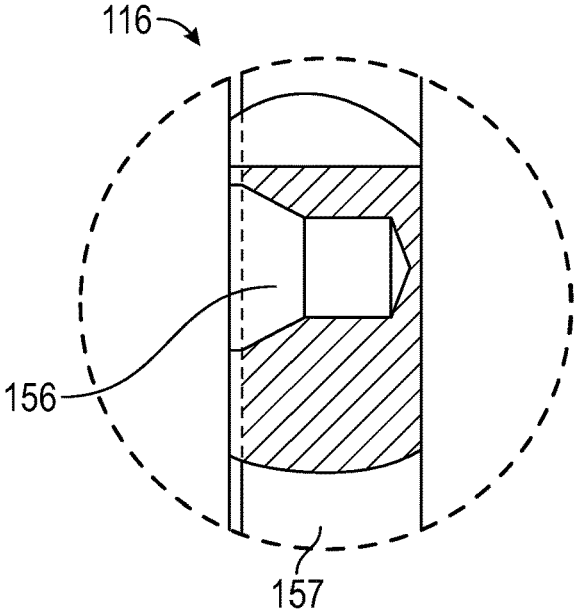
FIG. 23 is an enlarged cross-sectional view of the manifold orifice insert taken along line 23-23 of FIG. 22, according to one aspect of the present disclosure.
Figure 24:
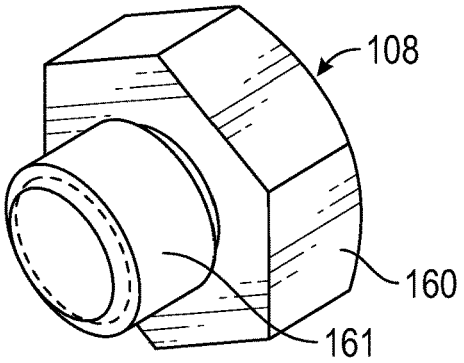
FIG. 24 is a perspective view of a plug used to seal the access opening of the manifold body, according to one aspect of the present disclosure.
Figure 25:
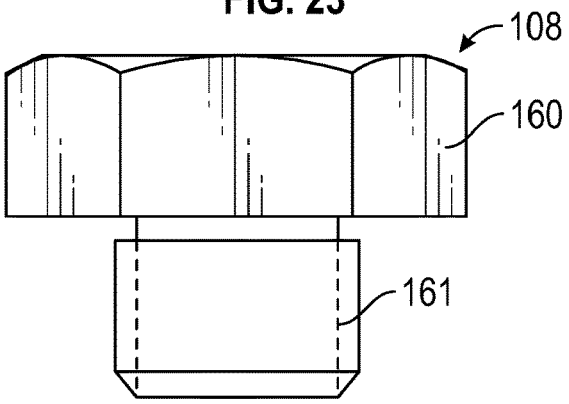
FIG. 25 is a side view of the plug of FIG. 24, according to one aspect of the present disclosure.
Figure 26:
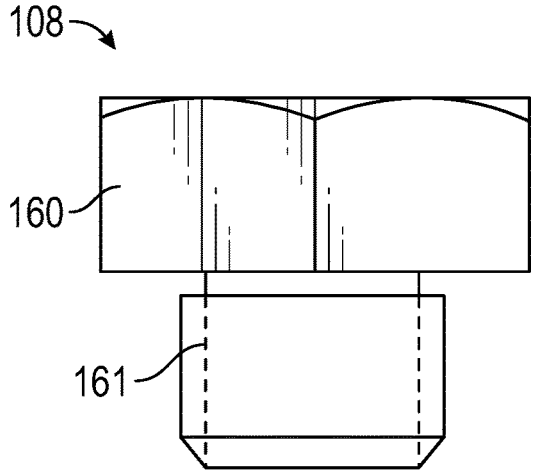
FIG. 26 is another side view of the plug of FIG. 24, according to one aspect of the present disclosure.
Figure 27:
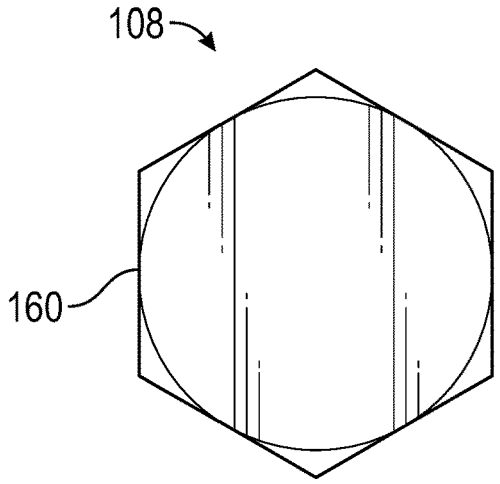
FIG. 27 is a top plan view of the plug of FIG. 24, according to one aspect of the present disclosure.
Figure 28:
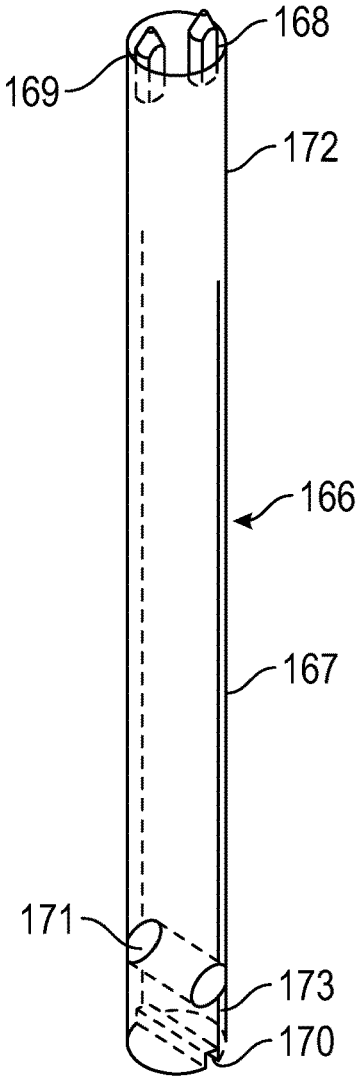
FIG. 28 is perspective view of an adjustment key for adjusting the flow rate of the adjustable flow nozzle, according to one aspect of the present disclosure.
Figure 29:
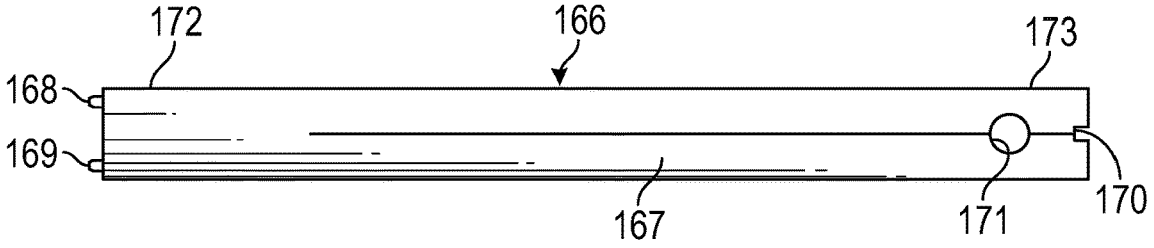
FIG. 29 is a side view of the adjustment key of FIG. 28, according to one aspect of the present disclosure.

As shown in FIGS. 17-19, the retainer orifice insert 114 defines a generally disc-shaped body 151 with a central opening 150 formed through the retainer orifice insert 114. In some embodiments, the retainer orifice insert 114 defines a pair of opposing first and second curved slots 162 and 163 formed through the disc body 151 that form a part of the collective opening 158 (FIGS. 38A-38K) with the manifold orifice retainer 116 that establishes fluid flow rate through each adjustable flow nozzle 104 as shall be discussed in greater detail below. In addition, the retainer orifice insert 114 defines a substantially circular-shaped peripheral edge that forms a key portion 152 that extends outwardly from the peripheral edge of the retainer orifice body 114. The key portion 152 is configured to align and fix the retainer orifice insert 114 in position between the nozzle component 110 and the manifold orifice insert 116 during assembly of the adjustable flow nozzle 104.

As shown in FIGS. 20-23, the manifold orifice insert 116 defines a generally disc-shaped body 157 with a central opening 154 formed through the manifold orifice insert 116. In some embodiments, the manifold orifice insert 116 defines a pair of opposing first and second curved slots 164 and 165 formed through the manifold orifice insert 116 that are identical in configuration to first and second slots 162 and 163 of the retainer orifice insert 114 that collectively form a part of the collective opening 158 (FIGS. 38A-38K) when aligned with the first and second curved slots 164 and 165 of the manifold orifice insert 116 to establish a rate of fluid flow through each adjustable flow nozzle 104 as shall be discussed in greater detail below. In addition, the manifold orifice insert 116 defines a substantially similar circular-shaped peripheral edge having a configuration that is substantially similar or identical to the retainer orifice insert 114. In some embodiments, the central opening 154 of the manifold orifice insert 116 has an identical configuration as the central opening 150 of the retainer orifice insert 114 and is co-axial alignment with the central opening 150 for establishing a non-zero minimum flow rate through the adjustable flow nozzle 104 when flow rate through the first curved slots 162/164 and second curved slots 163/165 is prevented (FIG. 38K) Referring to FIGS. 22 and 23, first and second first and second key receptacles 155 and 156 are formed through the rear surface 185 of the manifold orifice insert 116 which are configured to engage the adjustment key 166 when adjusting the flow rate of the adjustable flow nozzle 104 as shall be described in greater detail below.

As noted above, the rotation of the manifold orifice insert 116 relative to the stationary retainer orifice insert 114 causes the cross-sectional area of the collective opening 158 defined by the overlapping arrangement between the rotated first and second curved slots 164/165 of the manifold orifice insert 116 relative to the stationary first and second slots 162/163 of the retainer orifice insert 114 to change which adjusts the flow rate through the adjustable flow nozzle 104. In one aspect, the adjustable flow nozzle 104 is adjusted through the selective overlap between the aligned first curved slots 162/164 and aligned second curved slots 163/165 as the manifold orifice insert 116 is rotated about a common axis 204 (FIGS. 38A-38K) relative to the retainer orifice insert 114 which remains in a fixed position. As noted above, in some embodiments, the first and second curved slots 162 and 163 of the retainer orifice insert 114 and the first and second curved slots 164 and 165 of the manifold orifice insert 116 each define identical curved slots, although in other embodiments the first and second curved slots 162 and 163 and the first and second curved slots 164 and 165 may each define identical or differently shaped openings, such as semi-circular shaped opening, a rectangular-shaped opening, an irregular-shaped opening, an angular-shaped opening, and/or square-shaped opening other than a circular-shaped opening since rotation of a pair of circular-shaped openings along the same axis would not produce a change in cross-sectional area of the opening collectively defined by the overlapping arrangement. This overlapping arrangement between the first and second curved slots 162 and 163 with respective first and second curved slots 164 and 165 also allows the flow rate of the adjustable flow nozzle 104 to be manually adjusted in range between a non-zero minimum flow rate and a maximum flow rate. In particular, a non-zero minimum flow rate is achieved through the adjustable flow nozzle 104 since there will always be some degree of minimum fluid flow by virtue of the fluid flow communication through the central openings 150 and 154 despite the fact that the first and second curved slots 162 and 163 and the first and second curved slots 164 and 165 may be oriented such that the collective opening 158 is closed off to fluid flow communication as shown in FIG. 38K. In other embodiments in which there are no aligned central openings 150/154, the first and second curved slots 162 and 163 of the retainer orifice insert 114 and the first and second curved slots 164 and 165 of the manifold orifice insert 116 may be in an overlapping arrangement to establish a non-zero minimum flow rate through the adjustable flow nozzle 104 as shown in FIG. 38J.

Figure 30:
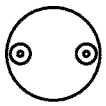
FIG. 30 is an end view of the adjustment key showing a first and second key elements, according to one aspect of the present disclosure.
Figure 31:
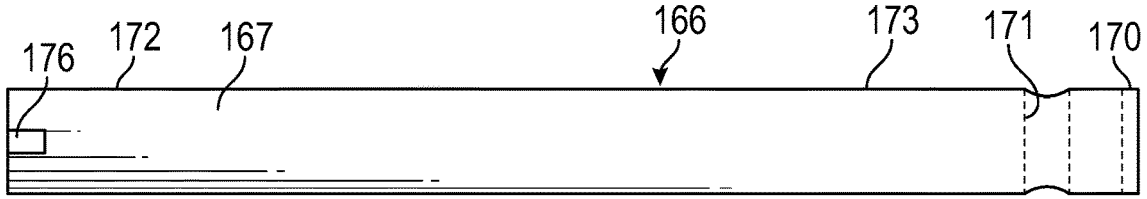
FIG. 31 is a side view of the adjustment key showing a first recess in phantom line configured to receive the first key element, according to one aspect of the present disclosure.
Figure 32:
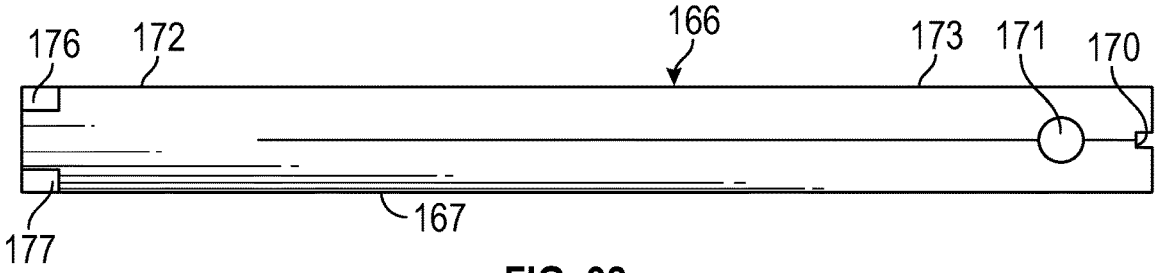
FIG. 32 is a side view of the adjustment key showing first and second recesses in phantom line configured to receive the first and second key elements, respectively, according to one aspect of the present disclosure.
Figure 33:
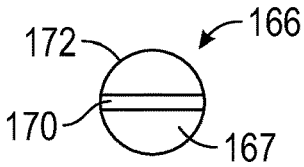
FIG. 33 is an end view of the adjustment key showing a notch, according to one aspect of the present disclosure.
Figure 34:
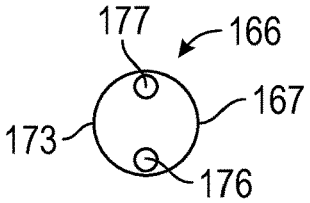
FIG. 34 is an opposite end view of the adjustment key shown in FIG. 33, according to one aspect of the present disclosure.

Referring to FIGS. 28-37 and 40, as described above the flow rate of the adjustable flow nozzle 104 may be adjusted by rotating the manifold orifice insert 116 using the adjustment key 166 in the direction indicated by the setting indicia 117 (FIG. 44) until the adjustable flow nozzle 104 is adjusted to the desired flow rate indicated by the setting indicia 117. In some embodiments, the adjustment key 166 includes an elongated key body 167 defining a distal portion 172 and a proximal portion 173 that is of sufficient length to allow the distal portion 172 to access the adjustable flow nozzle 104 through the channel 136. In some embodiments, first and second key elements 168 and 169 extend from the distal portion 172 of the elongated key body 167 which are configured to be received within the respective first and second key receptacles 155 and 156 of the manifold orifice insert 116. As shown in FIGS. 30-32, first and second pockets 176 and 177 are formed within the elongated key body 167 adjacent the distal portion 172 of the adjustment key 166 and are configured to receive a respective first key element 168 and second key element 169 in a tight engagement sufficient to prevent inadvertent disengagement of the first and second key elements 168 and 169. In other embodiments, the adjustment key 166 may include first and second key elements 168 and 169 which are formed integral with the distal portion 172 of the elongated key body 167. In some embodiments, the adjustment key 166 may define a channel 171 formed through the proximal portion 173 of the elongated key body 167. In some embodiments, a notch 170 may be defined along the proximal portion 173 of the elongated key body 167.

Figure 35:
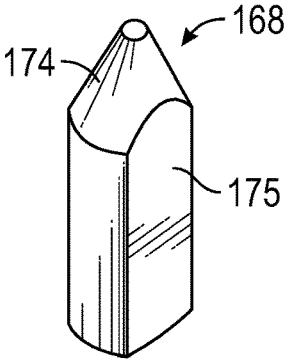
FIG. 35 is a perspective view of the first key element, according to one aspect of the present disclosure.
Figure 36:
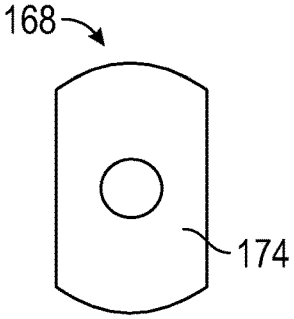
FIG. 36 is a top view of the first key element of FIG. 35, according to one aspect of the present disclosure.
Figure 37:
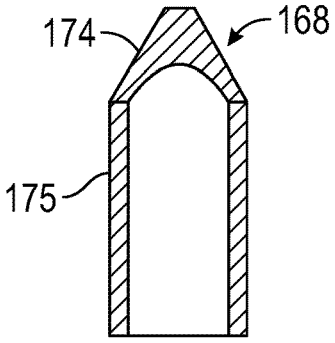
FIG. 37 is a cross-sectional view of the first key element of FIG. 35, according to one aspect of the present disclosure.
Figure 40:
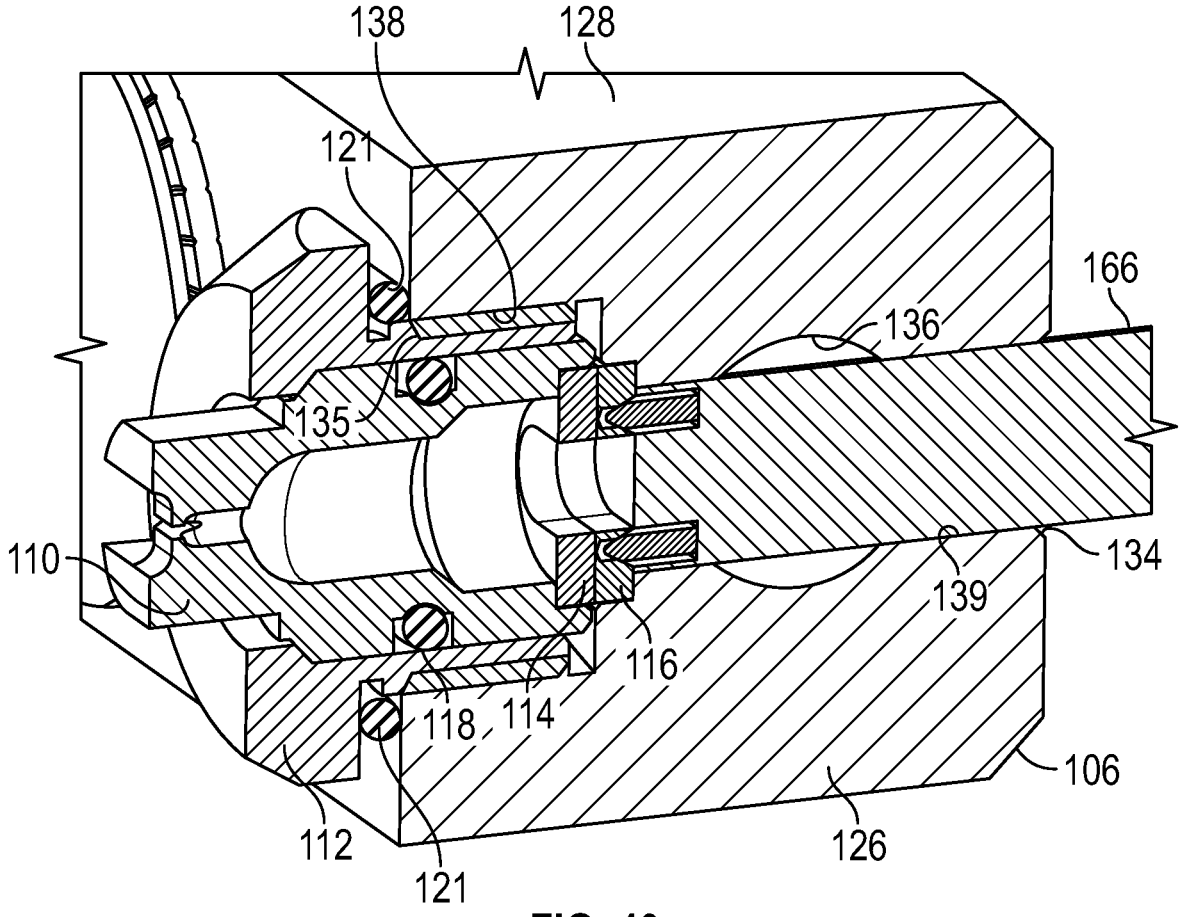
FIG. 40 is a cross-sectional view of the adjustable flow manifold showing the adjustment key engaged to the adjustable flow nozzle, according to one aspect of the present disclosure.

As shown in FIGS. 35-37, the first key element 168, which has an identical configuration as the second key element 169, may define an end portion 174 and a body portion 175. The end portion 175 forms a pointed shape configured to engage either the first or second key receptacles 155 and 156 of the manifold orifice insert 116 as shown in FIG. 40 and a body portion 175 configured to be disposed within either the first pocket 176 or the second pocket 177 of the elongated key body 167 such that the end portion 174 extends outwardly from the distal portion 172 of the adjustment key 166. In some embodiments, the end portion 175 may have a configuration similar to a conventional screw driver or a Phillips screw driver.

Figure 38A:
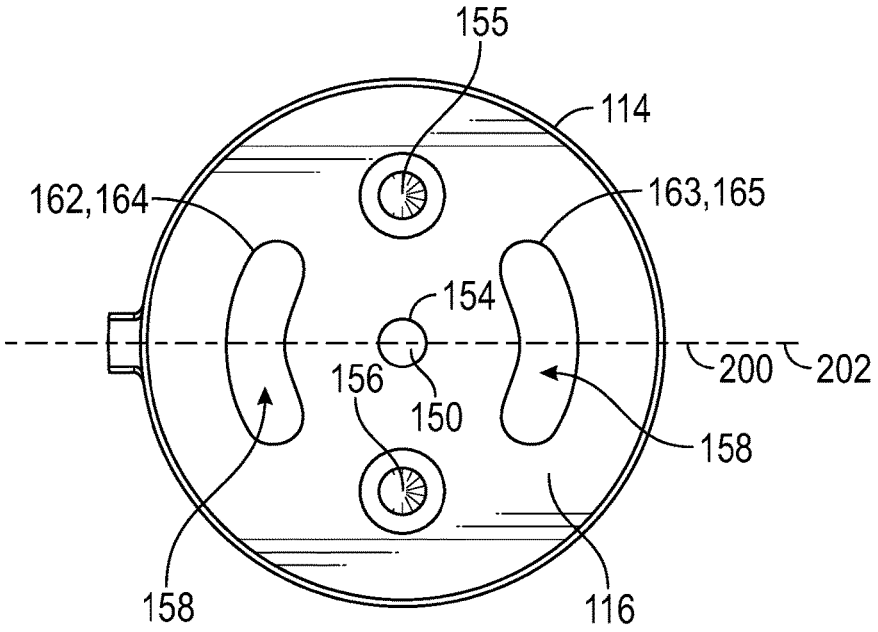
FIGS. 38A-38K show the sequence of rotation of the manifold orifice insert relative to the retainer orifice insert for the adjustable flow nozzle, according to one aspect of the present disclosure.
Figure 38B:
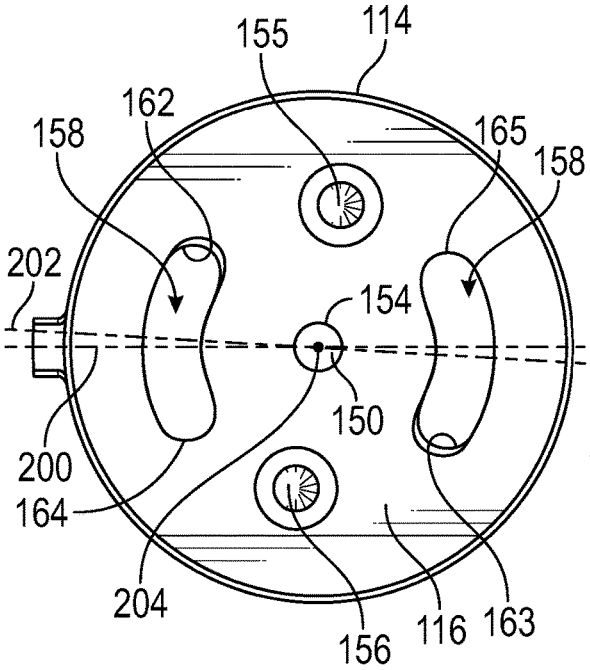
Figure 38C:
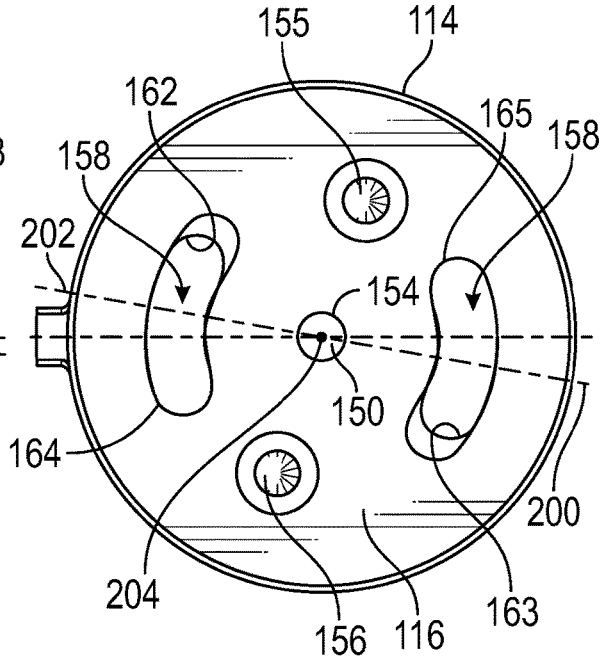
Figure 38D:
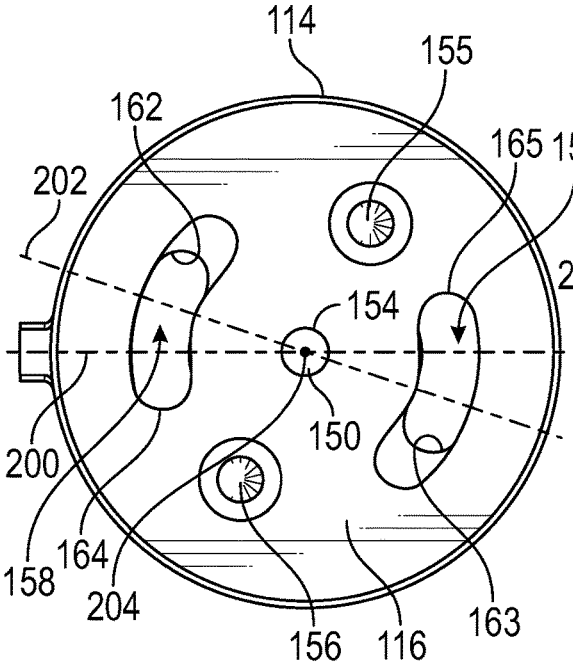
Figure 38E:
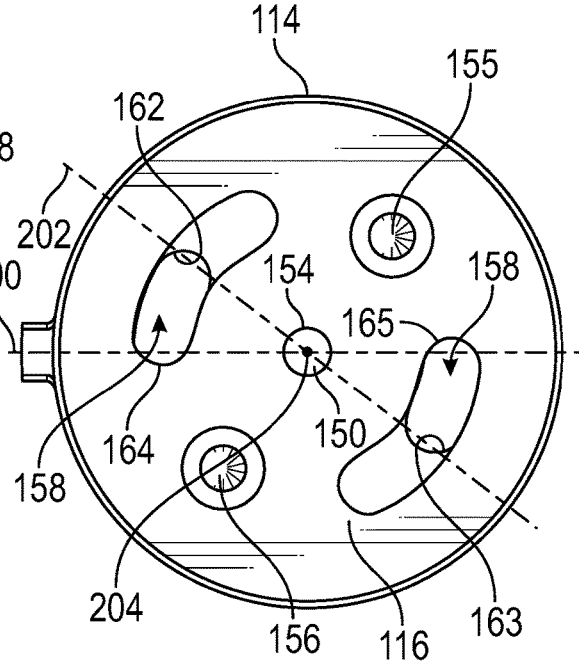
Figure 38F:
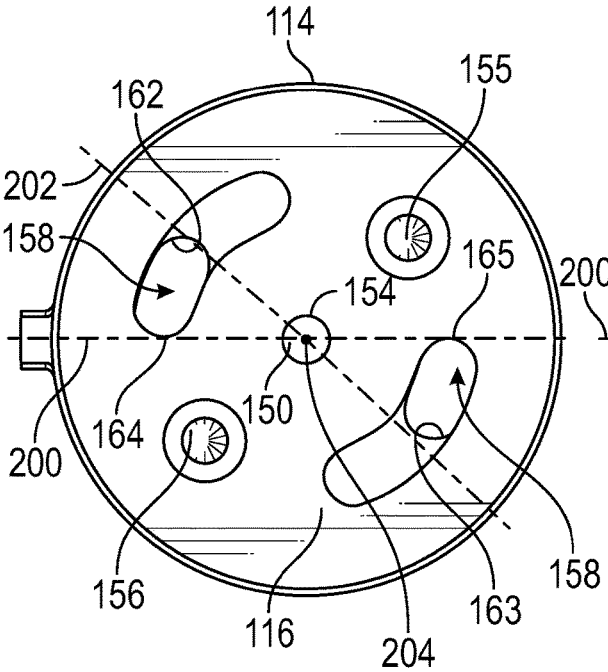
Figure 38G:
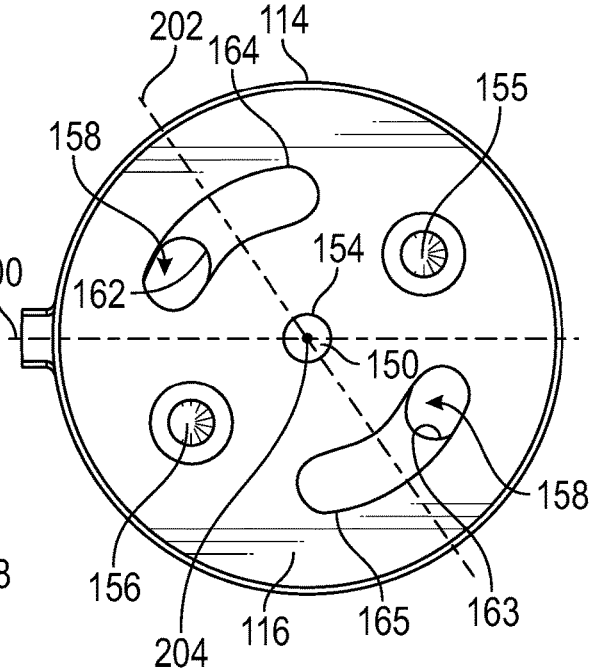
Figure 38H:
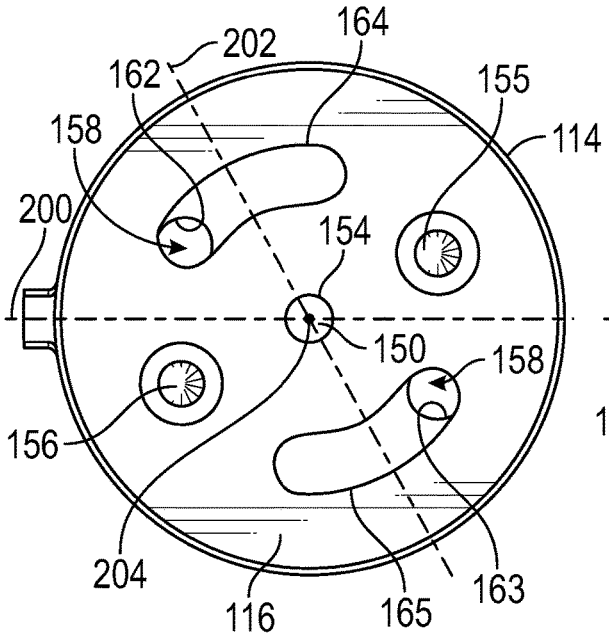
Figure 38I:
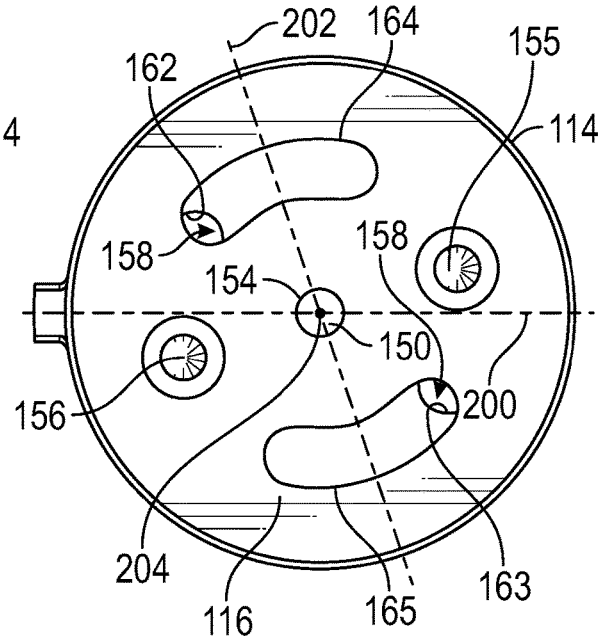
Figure 38J:
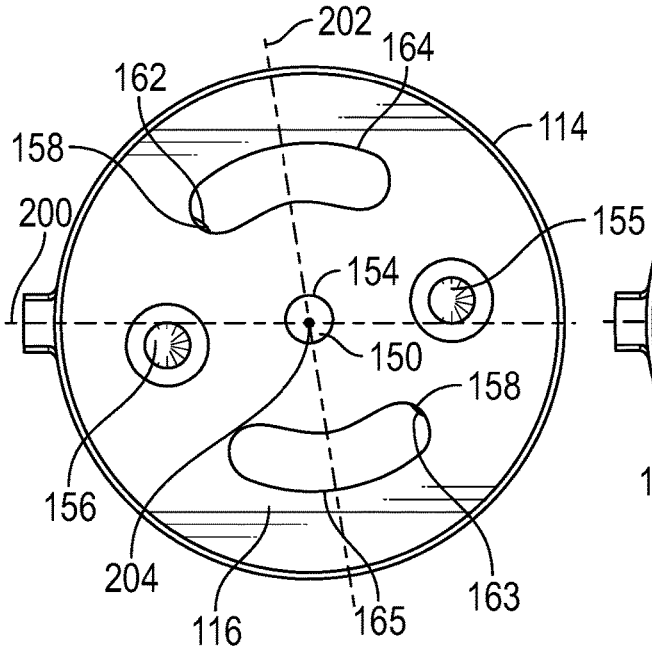
Figure 38K:
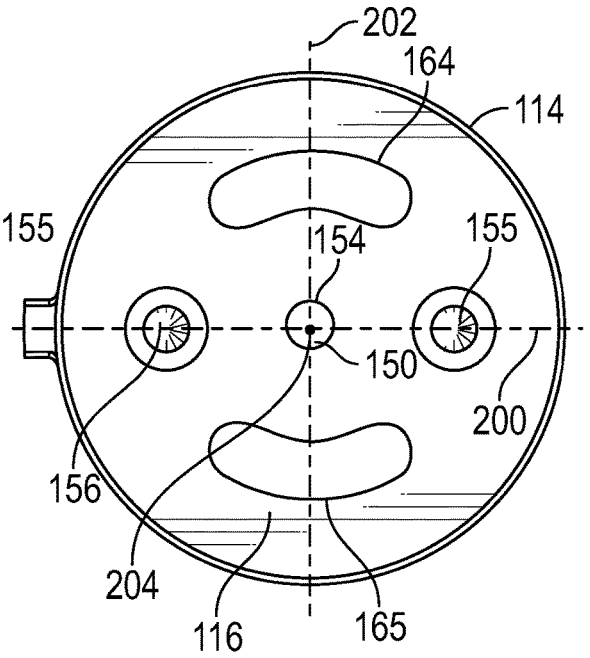

FIGS. 38A-38K illustrate a sequence of rotation of the manifold orifice insert 116 relative to the stationary retainer orifice insert 114 as the manifold orifice insert 116 is rotated by the adjustment key 166 to individually change the flow rate of each of the respective adjustable flow nozzles 104 along the adjustable flow manifold 102. Referring to FIG. 38A, the manifold orifice insert 116 and the retainer orifice insert 114 are aligned in an overlapping arrangement such that the longitudinal axis 200 of the first and second curved slots 162 and 163 of the retainer orifice insert 114 are aligned along the same orientation as the longitudinal axis 202 of the first and second curved slots 164 and 165 of the manifold orifice insert 116. In this orientation, the respective collective openings 158 formed by the overlapping relationship between aligned first curved slots 162/164 and the aligned second curved slots 163/165 each define the maximum cross-sectional area that can be defined by each respective collective opening 158. Referring to FIGS. 38B-38K, rotation of the manifold orifice insert 116 about central axis 204 in a clockwise direction (or counter-clockwise direction in an alternative embodiment) will gradually reduce the cross-sectional area of each respective collective opening 158 as the first and second curved slots 164 and 165 of the manifold orifice insert 116 are rotated relative to the stationary first and second curved slots 162 and 163 of the retainer orifice insert 114. Conversely, rotation of the manifold orifice insert 116 in a counter-clockwise direction (or clockwise direction in the alternative embodiment) will gradually increase the cross-sectional area of the collective opening 158. As shown in FIG. 38K, the manifold orifice insert 116 may be rotated such that the longitudinal axis 202 of the manifold orifice insert 116 is at a perpendicular relation relative to the longitudinal axis 200 of the retainer orifice insert 114. In this overlapping arrangement, the collective openings 158 are closed off to fluid flow communication such that the non-minimum flow rate is ached by fluid flow through the aligned central opening 150/154.

Figure 43:
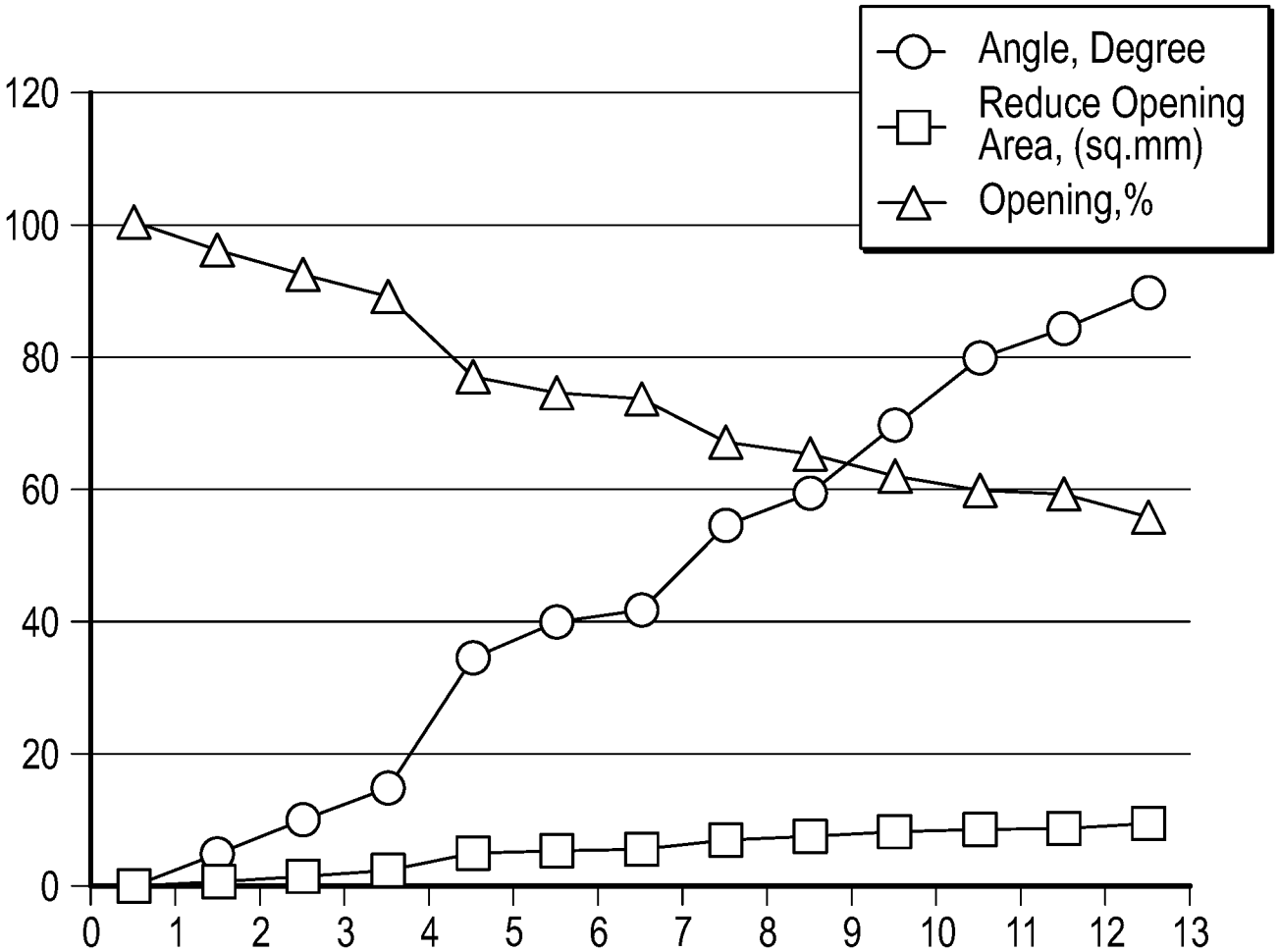
FIG. 43 is a chart illustrating the values for angle, reduction of opening area, and opening percentage shown in the table of FIG. 39, according to one aspect of the present disclosure.

As shown in FIG. 42, the table illustrates the reduction in cross-sectional area (sq. mm) of the collective opening 158 and the percentage that the collective opening 158 is reduced as the angle between the first and second longitudinal axes 200 and 202 increases. FIG. 43 is a graph that illustrates the relationship between the angles formed between the first and second longitudinal axes 200 and 202, the gradual reduction of the cross-sectional area of the collective opening 158 for each angle formed between the first and second longitudinal axes 200 and 202, and the percentage the collective opening 158 is reduced with each angle formed between the first and second longitudinal axes 200 and 202.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A method for adjusting flow rate for an adjustable flow nozzle system comprising:

providing an adjustable flow manifold comprising:

a manifold body defining an axial channel that extends between a distal end portion defining a distal opening and a proximal end portion defining a proximal opening, a plurality of access openings formed along one side of the manifold body and a plurality of apertures formed on an opposite side of the manifold body, wherein the plurality of access openings and apertures communicate with the axial channel, and a plurality adjustable flow nozzles coupled to a respective one of the plurality of apertures, each of the plurality of adjustable flow nozzles comprising:

a nozzle component configured for providing a fluid pathway for a fluid exiting the nozzle component;

a retainer orifice insert engaged to the nozzle component, the retainer orifice insert defining a first nozzle aperture; and a manifold orifice insert engaged to the retainer orifice insert, the manifold orifice insert defining a second nozzle aperture in co-axial relation with the first nozzle aperture in an overlapping arrangement such that a collective opening is defined by the overlapping arrangement of the first nozzle aperture and the second nozzle aperture, wherein the manifold orifice insert is operable to rotate relative to the retainer orifice insert such that the cross-sectional area of the collective opening is adjusted;

inserting an adjustment key having an elongated key body defining a proximal portion and a distal portion through one of the plurality of apertures, the adjustment key further comprising at least one key element extending from the proximal portion of the elongated key body, engaging the at least one key element of the adjustment key with a respective key receptacle formed along the manifold orifice insert; and rotating the adjustment key such that the manifold orifice insert is rotated relative to the retainer orifice insert for adjusting a cross-sectional area and flow rate through the collective opening.

2. The method of claim 1, wherein rotation of the manifold orifice insert relative to the retainer orifice insert adjusts the flow rate of each of the plurality of adjustable flow nozzles in a range between a non-zero minimum flow rate and a maximum flow rate.

3. The method of claim 1, wherein rotation of the manifold orifice insert relative to the retainer orifice insert adjusts the overlapping relation between the first nozzle aperture and the second nozzle aperture.

4. The method of claim 3, wherein rotation of the manifold orifice insert relative to the retainer orifice insert adjusts the overlapping relation between the first and second nozzle apertures such that each of the plurality of adjustable flow nozzles is adjustable between a non-zero minimum flow rate when minimum overlap between the first and second apertures occurs and a maximum flow rate when maximum overlap between the first and second apertures occurs.

* * * * *